US012442365B2

(12) United States Patent
Jung et al.

(10) Patent No.: US 12,442,365 B2
(45) Date of Patent: Oct. 14, 2025

(54) LINEAR COMPRESSOR

(71) Applicant: LG Electronics Inc., Seoul (KR)

(72) Inventors: Jinwoong Jung, Seoul (KR); Sangeun Bae, Seoul (KR); Chulgi Roh, Seoul (KR)

(73) Assignee: LG Electronics Inc., Seoul (KR)

( * ) Notice: Subject to any disclaimer, the term of this patent is extended or adjusted under 35 U.S.C. 154(b) by 223 days.

(21) Appl. No.: 18/204,495

(22) Filed: Jun. 1, 2023

(65) Prior Publication Data

US 2024/0102459 A1 Mar. 28, 2024

(30) Foreign Application Priority Data

Sep. 27, 2022 (KR) ..... 10-2022-0122231

(51) Int. Cl.
*F04B 39/00* (2006.01)
*F04B 39/02* (2006.01)
*F04B 39/10* (2006.01)

(52) U.S. Cl.
CPC ..... *F04B 39/0027* (2013.01); *F04B 39/0276* (2013.01); *F04B 39/10* (2013.01)

(58) Field of Classification Search
CPC .. F04B 39/0027; F04B 39/0276; F04B 39/10; F04B 39/0061; F04B 39/06;
(Continued)

(56) References Cited

U.S. PATENT DOCUMENTS 7,540,720 B2 * 6/2009 Enokijima ..... F04B 39/06 417/313
9,909,581 B2 * 3/2018 Lilie ..... F04B 39/0055
(Continued)

FOREIGN PATENT DOCUMENTS

EP 3587813 1/2020
EP 4008902 3/2022
(Continued)

OTHER PUBLICATIONS

Office Action in European application No. 23181943.4, mailed on Oct. 4, 2024, 4 pages.
(Continued)

*Primary Examiner* — Mark A Laurenzi
*Assistant Examiner* — Benjamin Doyle
(74) *Attorney, Agent, or Firm* — Fish & Richardson P.C.

(57) ABSTRACT

A linear compressor includes a frame, a cylinder disposed in the frame, a piston configured to axially reciprocate in the piston, a discharge valve disposed at a front of the piston, and a discharge cover assembly coupled to the frame and disposed at the front of the piston. The discharge cover assembly includes a discharge cover including an inner space, a first discharge plenum that is disposed in the inner space of the discharge cover and defines a first discharge space inside the first discharge plenum, and a second discharge plenum disposed between the first discharge plenum and the discharge cover. The second discharge plenum defines a second discharge space in fluid communication with the first discharge space and a third discharge space in fluid communication with the second discharge space between the first discharge plenum and the second discharge plenum.

18 Claims, 9 Drawing Sheets

(58) Field of Classification Search
CPC ..... F04B 39/125; F04B 35/045; F04B 35/04; F04B 39/0005; F04B 39/12; F04B 39/121; F04B 39/0055; F04B 39/064; F04B 39/123; F04B 39/14; F04B 17/04; F04B 17/046; F04B 2201/0801; F04B 27/1081; F04B 39/0038; F04B 39/0292; F04B 39/08; F04B 39/102; F04B 39/1066; F04B 39/122; F04B 49/08; F04B 49/22; F04B 53/001; F04B 53/007; F04B 53/008; F04B 53/1037; F04B 53/106; F04B 53/1085; F04B 53/16; F04B 53/162; F04B 53/18; F05B 2210/14; F05B 2280/4006; F25B 2400/073; F25B 1/02
USPC ..... 417/437
See application file for complete search history.

(56) References Cited

U.S. PATENT DOCUMENTS

| | | | | |
|---|---|---|---|---|
| 10,670,004 | B2 * | 6/2020 | Bae | F04B 39/123 |
| 10,935,017 | B2 * | 3/2021 | Kim | F04B 35/04 |
| 2003/0133816 | A1 * | 7/2003 | Park | F04B 39/0061 417/551 |
| 2005/0106034 | A1 * | 5/2005 | Enokijima | F04B 27/1081 417/313 |
| 2008/0260561 | A1 * | 10/2008 | Ribas | F04B 39/1066 415/177 |
| 2014/0322040 | A1 * | 10/2014 | Cho | F04B 39/125 417/312 |
| 2016/0305430 | A1 * | 10/2016 | Mahure | F01C 21/10 |
| 2018/0223825 | A1 * | 8/2018 | Cho | F16L 17/063 |
| 2020/0003198 | A1 * | 1/2020 | Noh | F04B 39/0061 |
| 2020/0003200 | A1 * | 1/2020 | Noh | F04B 39/125 |
| 2021/0054833 | A1 * | 2/2021 | Lee | F25B 1/02 |
| 2021/0095653 | A1 * | 4/2021 | Kim | F04B 39/122 |
| 2021/0108628 | A1 * | 4/2021 | Lee | F04B 39/121 |
| 2021/0333023 | A1 * | 10/2021 | Hahn | F04B 39/064 |
| 2021/0396224 | A1 * | 12/2021 | Bae | F04B 39/0005 |
| 2022/0170450 | A1 * | 6/2022 | Gong | F04B 39/125 |
| 2022/0178361 | A1 * | 6/2022 | Jeon | F04B 35/045 |
| 2022/0235752 | A1 * | 7/2022 | Cho | F04B 39/122 |
| 2023/0003206 | A1 * | 1/2023 | Hahn | F04B 39/0061 |

FOREIGN PATENT DOCUMENTS

| | | |
|---|---|---|
| EP | 3848581 | 6/2022 |
| KR | 10-2019-0118426 | 10/2019 |
| KR | 102430410 | 8/2022 |

OTHER PUBLICATIONS

Extended European Search Report in European Appln. No. 23181943.4, mailed on Feb. 26, 2024, 7 pages.
Office Action in Korean Appln. No. 10-2022-0122231, mailed on Jan. 25, 2024, 10 pages (with English translation).

* cited by examiner

LINEAR COMPRESSOR

CROSS-REFERENCE TO RELATED APPLICATION

This application claims priority to and the benefit of Korean Patent Application No. 10-2022-0122231, filed in the Korean Intellectual Property Office, on Sep. 27, 2022.

TECHNICAL FIELD

The present disclosure relates to a linear compressor. More specifically, the present disclosure relates to a linear compressor for compressing a refrigerant by a linear reciprocating motion of a piston.

BACKGROUND

A compressor refers to a device that is configured to receive power from a power generator such as a motor or a turbine and compress a working fluid such as air or refrigerant.

The compressors may be classified into a reciprocating compressor, a rotary compressor, and a scroll compressor depending on a method of compressing the refrigerant.

The reciprocating compressor may perform a method in which a compression space is formed between a piston and a cylinder, and the piston linearly reciprocates to compress a fluid. The rotary compressor uses a method of compressing a fluid by a roller that eccentrically rotates inside a cylinder. The scroll compressor may use a method for compressing a fluid by engaging and rotating a pair of spiral scrolls.

In some cases, the reciprocating compressors may include linear compressors that use a linear reciprocating motion without using a crank shaft.

In some cases, the compressor may have advantages in that it has less mechanical loss resulting from switching a rotary motion to the linear reciprocating motion and thus can improve the efficiency, and has a relatively simple structure.

A linear compressor may include a cylinder that is positioned in a casing forming a sealed space to form a compression chamber, and a piston that reciprocates in the cylinder.

The linear compressor may repeat a process in which a fluid in the sealed space is suctioned into the compression chamber while the piston moves to a bottom dead center (BDC), and after the fluid of the compression chamber is compressed while the piston moves to a top dead center (TDC), the fluid is discharged through a discharge space.

The linear compressor may be classified into an oil lubricated linear compressor and a gas lubricated linear compressor according to a lubrication method.

The oil lubricated linear compressor may be configured to lubricate between the cylinder and the piston using an oil stored in the casing.

The gas lubricated linear compressor may be configured to induce some of a discharge refrigerant between the cylinder and the piston and lubricate between the cylinder and the piston by a gas force of the refrigerant.

The oil lubricated linear compressor may supply the oil of a relatively low temperature between the cylinder and the piston to suppress the cylinder and the piston from being overheated by heat or compression heat of a motor, etc.

In some cases, the oil lubricated linear compressor may suppress a specific volume from increasing as the refrigerant passing through an intake flow path of the piston is suctioned into the compression chamber of the cylinder and is heated, to prevent in advance an intake loss from occurring.

In some cases, when the oil discharged to a refrigeration cycle device together with the refrigerant is not smoothly returned to the compressor, the oil lubricated linear compressor may experience an oil shortage in the casing of the compressor. The oil shortage in the casing may lead to a reduction in reliability of the compressor.

In some cases, the gas lubricated linear compressor may have advantages in that it can be made smaller than the oil lubricated linear compressor, and there is no reduction in the reliability of the compressor due to the oil shortage because it lubricates between the cylinder and the piston using the refrigerant.

In some cases, a linear compressor may include a discharge cover assembly forming a refrigerant discharge space, where the discharge cover assembly may include a discharge cover and two discharge plenums disposed in the discharge cover.

The discharge plenums may prevent discharge refrigerant of a high temperature from directly contacting the discharge cover, and the linear compressor having the above-described configuration may have an effect of somewhat suppressing heat of the discharge refrigerant from being transferred to the discharge cover and a frame coupled to the discharge cover.

In some cases, the linear compressor of related art may have a rigidity that is weak due to the simple structure of the discharge plenum. In some cases, the discharge plenum may not include a structure for reducing a pulsation noise of the discharge refrigerant, which may generate relatively large noise caused by the discharge pulsation.

For instance, a hitting sound of a discharge valve may be a main noise source of the linear compressor and may not be reduced.

In some cases, a refrigerant flow path may be formed in the discharge cover so as to lubricate the cylinder and the piston using some of the discharge refrigerant, where the processing and manufacturing of the discharge cover are difficult.

SUMMARY

The present disclosure describes a linear compressor configured to efficiently suppress heat of a discharge refrigerant from being transferred to a discharge cover and a frame coupled to the discharge cover.

The present disclosure describes a linear compressor having an increasing rigidity of a discharge plenum that is disposed inside a discharge cover and defines a plurality of discharge spaces.

The present disclosure describes a linear compressor configured to efficiently reduce a noise caused by a discharge pulsation. The present disclosure describes a linear compressor configured efficiently reduce a hitting sound of a discharge valve which is a main noise source of the linear compressor.

The present disclosure describes a linear compressor shortening a movement path of a discharge refrigerant supplied to a gas bearing.

The present disclosure describes a linear compressor in which processing and manufacturing of a discharge cover are easy.

According to one aspect of the subject matter described in this application, a linear compressor includes a frame, a cylinder disposed in the frame, a piston disposed in the cylinder and configured to axially reciprocate in the cylinder, a discharge valve disposed at a first side of the piston, and a discharge cover assembly coupled to the frame and disposed at the first side of the piston. The discharge cover assembly includes a discharge cover that defines an inner space, a first discharge plenum that is disposed in the inner space of the discharge cover, the first discharge plenum defining a first discharge space therein, and a second discharge plenum disposed between the first discharge plenum and the discharge cover. The second discharge plenum defines (i) a second discharge space in fluid communication with the first discharge space and (ii) a third discharge space in fluid communication with the second discharge space, where the second discharge space and the third discharge space are defined between the first discharge plenum and the second discharge plenum.

Implementations according to this aspect can include one or more of the following features. For example, a heat transfer coefficient of a material of the first discharge plenum and the second discharge plenum is different from a heat transfer coefficient of a material of the discharge cover. In some examples, at least one of the first discharge plenum or the second discharge plenum is made of a polyamide resin.

In some implementations, the first discharge plenum can include a first cylindrical body that defines the first discharge space, the first discharge space being configured to receive refrigerant discharged through the discharge valve. The first discharge plenum can further include a first bottom portion that supports the first cylindrical body, a first pillar that protrudes from a central part of the first cylindrical body toward the discharge valve, and a first wall that has a ring shape protruding from the first bottom portion and surrounding the first cylindrical body. In some examples, the first pillar can define a plurality of first discharge holes at a bottom surface of the first pillar, where the plurality of first discharge holes pass through the bottom surface of the first pillar and are configured to discharge the refrigerant from the second discharge space of the second discharge plenum.

In some implementations, the frame can define a first bearing communication hole, where the first bottom portion defines a second bearing communication hole in fluid communication with the third discharge space, and the second bearing communication hole is configured to provide a portion of the refrigerant in the third discharge space to the first bearing communication hole to thereby lubricate the cylinder and the piston. In some examples, the first wall and the first cylindrical body can be spaced apart from each other and define a pulsation reduction space between an inner surface of the first wall and an outer surface of the first cylindrical body, where the pulsation reduction space is configured to reduce a discharge pulsation of the refrigerant.

In some examples, the outer surface of the first cylindrical body defines a first inlet hole configured to introduce the refrigerant from the second discharge space into the pulsation reduction space, and the first wall can define a second discharge hole configured to introduce the refrigerant from the pulsation reduction space into the third discharge space. In some examples, the second discharge plenum can include a second wall, at least a portion of the second wall being inserted into the pulsation reduction space of the first discharge plenum. In some implementations, a thickness of the second wall can be equal to a width of the pulsation reduction space, and a length of the portion of the second wall inserted into the pulsation reduction space can be less than a depth of the pulsation reduction space.

In some implementations, the first discharge plenum includes at least two of: a plurality of first reinforcement ribs that protrude from an inner wall surface of the first cylindrical body toward the first discharge space and extend axially; a second reinforcement rib that has a ring shape and protrudes from an inner upper surface of the first cylindrical body toward the first discharge space; a plurality of third reinforcement ribs that protrude from an inner wall surface of the first pillar toward the first discharge space and extends axially; a fourth reinforcement rib that is disposed at an outer wall surface of the first pillar and partitions the plurality of first discharge holes; a plurality of fifth reinforcement ribs that protrudes from an inner wall surface of the first bottom portion toward the first discharge space; and a plurality of sixth reinforcement ribs that protrude from an outer wall surface of the first wall toward the second discharge plenum and extend axially.

In some examples, the first discharge plenum can include the plurality of first reinforcement ribs, the second reinforcement rib, and the plurality of third reinforcement ribs that are integrally formed with the first discharge plenum, where a number of the plurality of first reinforcement ribs is equal to a number of the plurality of third reinforcement ribs, each of the plurality of first reinforcement ribs facing one of the plurality of third reinforcement ribs. The second reinforcement rib can include a bridge portion that connects one of the plurality of first reinforcement ribs to one of the plurality of third reinforcement ribs.

In some implementations, the second discharge plenum can include a second cylindrical body and a second bottom portion that supports the second cylindrical body, where the first discharge plenum includes the plurality of sixth reinforcement ribs. The second discharge plenum can further include a plurality of seventh reinforcement ribs that protrude from an inner wall surface of the second cylindrical body toward the third discharge space and extends axially, where the plurality of sixth reinforcement ribs and the plurality of seventh reinforcement ribs are disposed in the third discharge space, and the third discharge space is defined between an outer surface of the first wall and an inner surface of the second cylindrical body and configured to reduce a discharge pulsation of the refrigerant.

In some examples, the plurality of sixth reinforcement ribs of the first discharge plenum can be disposed at positions offset from the plurality of seventh reinforcement ribs of the second discharge plenum. In some implementations, the second discharge plenum can further include a plurality of eighth reinforcement ribs that protrude from the inner surface of the second cylindrical body toward the discharge valve and extends radially, and at least one ninth reinforcement rib that protrudes from the inner surface of the second cylindrical body toward the discharge valve and extends in a circumferential direction of the second cylindrical body, where the plurality of eighth reinforcement ribs are connected to the at least one ninth reinforcement rib, and the plurality of eighth reinforcement ribs and the at least one ninth reinforcement rib are formed integrally with the second discharge plenum.

In some implementations, the second cylindrical body can further define a third discharge hole configured to discharge the refrigerant toward an outside of the discharge cover assembly, where the linear compressor further includes a loop pipe that is connected to the third discharge hole. In some examples, the second discharge plenum can define an O-ring insertion groove at an outer surface of the second bottom portion, where an O-ring can be inserted into the O-ring insertion groove and positioned between the second bottom portion and the discharge cover.

In some implementations, the discharge cover can include a third cylindrical body and a third bottom portion that supports the third cylindrical body, where the frame includes a flange portion that is coupled to the third bottom portion by a mechanical coupling member. In some examples, an inner wall surface of the third cylindrical body and an outer wall surface of the second cylindrical body can be spaced apart from each other and define a thermal insulation space between the inner wall surface of the third cylindrical body and the outer wall surface of the second cylindrical body.

In some implementations, the first discharge plenum or the second discharge plenum can be made of a polyamide resin.

In some implementations, since the first discharge plenum and the second discharge plenum are disposed in the inner space of the discharge cover, heat of a discharge refrigerant can be efficiently suppressed from being transferred to the discharge cover and the frame coupled to the discharge cover.

The first discharge plenum can be formed of a material having a heat transfer coefficient different from a heat transfer coefficient of a material forming the discharge cover.

For example, the first discharge plenum can be formed of a polyamide resin, for example, polyamide 66 (PA66).

The second discharge plenum can be formed of a material having a heat transfer coefficient different from a heat transfer coefficient of a material forming the discharge cover and/or a material forming the first discharge plenum.

For example, the second discharge plenum can be formed of a polyamide resin, for example, polyamide 66 (PA66).

According to the above-described configuration, heat of the discharge refrigerant transferred to the discharge cover can be more efficiently reduced.

The first discharge plenum can include a first cylindrical body forming the first discharge space into which a refrigerant discharged through the discharge valve is introduced, a first bottom portion supporting the first cylindrical body, a first pillar that protrudes rearward from a central part of the first cylindrical body toward the discharge valve and has a predetermined depth, and a ring-shaped first wall protruding from the first bottom portion and surrounding the first cylindrical body.

A plurality of first discharge holes can be formed in a bottom surface of the first pillar. The plurality of first discharge holes can pass through the bottom surface of the first pillar and discharge the refrigerant introduced through the discharge valve into the second discharge space of the second discharge plenum.

A first bearing communication hole formed in the frame and a second bearing communication hole communicating with the third discharge space can be formed in a part of the first bottom portion. Some of the refrigerant in the third discharge space can flow into the first bearing communication hole through the second bearing communication hole and lubricate the cylinder and the piston.

According to the above-described configuration, the discharge cover can be easily processed and manufactured compared to when the second bearing communication hole communicating with the first bearing communication hole is formed in the discharge cover.

The first wall can be formed at a predetermined distance from the first cylindrical body. A pulsation reduction space for reducing a discharge pulsation of the refrigerant can be formed between an inner wall surface of the first wall and an outer wall surface of the first cylindrical body.

According to the above-described configuration, a noise caused by discharge pulsation of the refrigerant can be reduced.

A first inlet hole for introducing the refrigerant in the second discharge space into the pulsation reduction space can be formed in a part of the outer wall surface of the first cylindrical body. A second discharge hole for introducing the refrigerant in the pulsation reduction space into the third discharge space can be formed in a part of the first wall.

According to the above-described configuration, the introduction of the refrigerant into the pulsation reduction space and the discharge of the refrigerant from the pulsation reduction space can be smoothly performed.

The second discharge plenum can further include a second wall inserted into the pulsation reduction space of the first discharge plenum.

According to the above-described configuration, the pulsation reduction effect can be further improved.

A thickness of the second wall can be the same as a width of the pulsation reduction space. A depth at which the second wall is inserted into the pulsation reduction space can be less a depth of the pulsation reduction space.

According to the above-described configuration, the pulsation reduction space can be efficiently formed.

The first discharge plenum can include at least two of a plurality of first reinforcement ribs that protrude from an inner wall surface of the first cylindrical body toward the first discharge space and elongate axially; a ring-shaped second reinforcement rib protruding from an inner upper surface of the first cylindrical body toward the first discharge space; a plurality of third reinforcement ribs that protrude from an inner wall surface of the first pillar toward the first discharge space and elongate axially; a fourth reinforcement rib that is positioned on an outer wall surface of the first pillar and spatially partitions the plurality of first discharge holes; a plurality of fifth reinforcement ribs protruding from an inner wall surface of the first bottom portion toward the first discharge space; and a plurality of sixth reinforcement ribs that protrude from an outer wall surface of the first wall toward the second discharge plenum and elongate axially.

According to the above-described configuration, rigidity of the first discharge plenum can increase.

The first discharge plenum can include the first reinforcement rib, the second reinforcement rib, and the third reinforcement rib.

In this case, the first reinforcement ribs and the third reinforcement ribs can be formed in the same number as each other and can be formed at positions facing each other. The second reinforcement rib can include a bridge portion connected to the first reinforcement rib and the third reinforcement rib. The first reinforcement rib, the second reinforcement rib, and the third reinforcement rib can be integrally formed.

According to the above-described configuration, the rigidity of the first discharge plenum can more efficiently increase.

The second discharge plenum can include a second cylindrical body and a second bottom portion supporting the second cylindrical body. The first discharge plenum can include the plurality of sixth reinforcement ribs. The second discharge plenum can further include a plurality of seventh reinforcement ribs that protrude from an inner wall surface of the second cylindrical body toward the third discharge space and elongate axially. The plurality of sixth reinforcement ribs and the plurality of seventh reinforcement ribs can be positioned in the third discharge space formed between an outer surface of the first wall and an inner surface of the second cylindrical body and can reduce a discharge pulsation of the refrigerant.

According to the above-described configuration, the rigidity of the second discharge plenum can increase, and pulsation of the discharge refrigerant can further decrease.

In a state in which the first discharge plenum and the second discharge plenum are coupled, the plurality of sixth reinforcement ribs can be disposed not to match the plurality of seventh reinforcement ribs.

In this case, the plurality of seventh reinforcement ribs can be disposed at an intermediate point between the two adjacent sixth reinforcement ribs.

According to the above-described configuration, the pulsation reduction effect can be further improved.

A plurality of eighth reinforcement ribs protruding toward the discharge valve and elongating radially, and at least one ninth reinforcement rib protruding toward the discharge valve and formed in a circumferential direction can be formed on the inner surface of the second cylindrical body. The eighth reinforcement rib and the at least one ninth reinforcement rib can be connected to each other and formed integrally.

According to the above-described configuration, the rigidity of the second discharge plenum can increase.

The second cylindrical body can further include a third discharge hole for discharging the refrigerant flowing in an inner space of the discharge cover assembly to an outside. A loop pipe can be connected to the third discharge hole.

An O-ring insertion groove, into which an O-ring is inserted, can be formed on an outer surface of the second bottom portion. The O-ring inserted into the O-ring insertion groove can be positioned between the second bottom portion and the discharge cover.

According to the above-described configuration, a hitting sound of the discharge valve, which is a main noise source of the linear compressor, can be efficiently reduced.

The discharge cover can include a third cylindrical body and a third bottom portion supporting the third cylindrical body. The third bottom portion can be coupled to a flange portion of the frame by a mechanical coupling member.

According to the above-described configuration, the discharge cover assembly can be easily installed at the frame.

An inner wall surface of the third cylindrical body and an outer wall surface of the second cylindrical body can be spaced apart from each other to form a thermal insulation space between the inner wall surface of the third cylindrical body and the outer wall surface of the second cylindrical body.

Effects that could be achieved with the present disclosure are not limited to those that have been described hereinabove merely by way of example, and other effects and advantages of the present disclosure will be more clearly understood from the following description by a person skilled in the art to which the present disclosure pertains.

BRIEF DESCRIPTION OF THE DRAWINGS

The accompanying drawings, which are included to provide a further understanding of the present disclosure and constitute a part of the detailed description, illustrate implementations of the present disclosure and serve to explain technical features of the present disclosure together with the description.

DETAILED DESCRIPTION

Reference will now be made in detail to implementations of the present disclosure, examples of which are illustrated in the accompanying drawings. Wherever possible, the same reference numbers will be used throughout the drawings to refer to the same or like parts.

Figure 1:
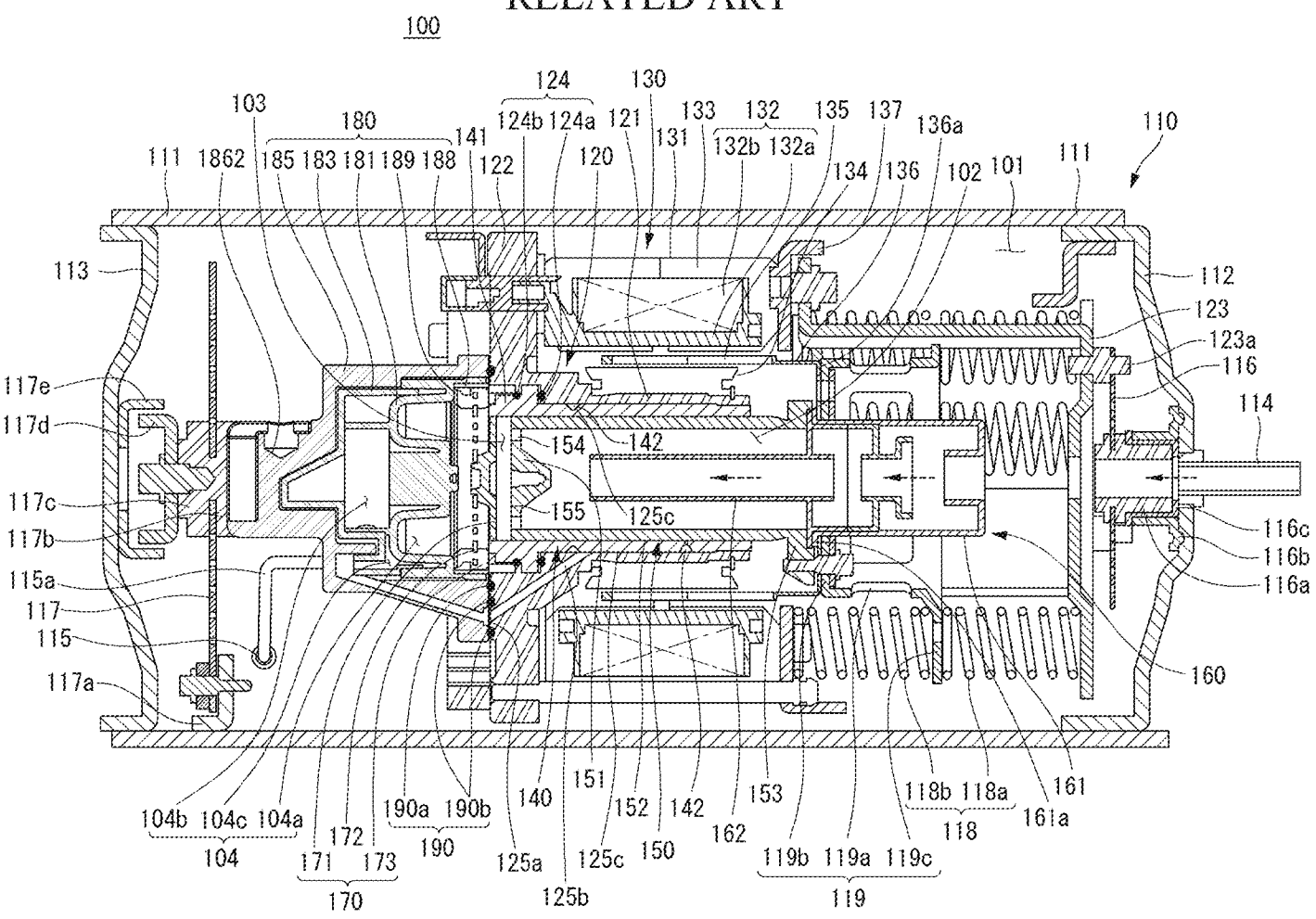
FIG. 1 RELATED ART
FIG. 1 is a cross-sectional view showing a linear compressor in related art.

With reference to FIG. 1, an example configuration of a linear compressor in related art is roughly described.

FIG. 1 is a cross-sectional view showing a linear compressor in related art.

Referring to FIG. 1, a linear compressor 100 can include a shell 111 and shell covers 112 and 113 coupled to the shell 111. In a broad sense, the shell covers 112 and 113 can be understood as one configuration of the shell 111.

Legs can be coupled to a lower side of the shell 111. The legs can be coupled to a base of a product on which the linear compressor 100 is mounted.

For example, the product can include a refrigerator, and the base can include a machine room base of the refrigerator. As another example, the product can include an outdoor unit of an air conditioner, and the base can include a base of the outdoor unit.

The shell 111 can have a substantially cylindrical shape and can be disposed to lie in a horizontal direction or an axial direction.

FIG. 1 illustrates that the shell 111 is extended in the horizontal direction and has a slightly low height in a radial direction, by way of example. That is, since the linear compressor 100 can have a low height, there is an advantage in that a height of the machine room can decrease when the linear compressor 100 is installed in, for example, the machine room base of the refrigerator.

A longitudinal central axis of the shell 111 coincides with a central axis of a main body of the linear compressor 100 to be described below, and the central axis of the main body of the linear compressor 100 can coincide with a central axis of a cylinder 140 and a piston 150 that constitute the main body of the linear compressor 100.

A terminal can be installed on an outer surface of the shell 111. The terminal can transmit external electric power to a drive unit 130 of the linear compressor 100. More specifically, the terminal can be connected to a lead line of a coil 132*b*.

A bracket can be installed on the outside of the terminal. The bracket can include a plurality of brackets surrounding the terminal. The bracket can perform a function of protecting the terminal from an external impact, etc.

Both sides of the shell 111 can be opened. The shell covers 112 and 113 can be coupled to both sides of the opened shell 111.

More specifically, the shell covers 112 and 113 can include a first shell cover 112 coupled to one opened side of the shell 111 and a second shell cover 113 coupled to the other opened side of the shell 111. An inner space of the shell 111 can be sealed by the shell covers 112 and 113.

FIG. 1 illustrates that the first shell cover 112 is positioned on the right side of the linear compressor 100, and the second shell cover 113 is positioned on the left side of the linear compressor 100, by way of example. In other words, the first and second shell covers 112 and 113 can be disposed to face each other.

It can be understood that the first shell cover 112 is positioned on an intake side of a refrigerant, and the second shell cover 113 is positioned on a discharge side of the refrigerant.

The linear compressor 100 can include a plurality of pipes that are included in the shell 111 or the shell covers 112 and 113 and can suction, discharge, or inject the refrigerant.

The plurality of pipes can include an intake pipe 114 that allows the refrigerant to be suctioned into the linear compressor 100, a discharge pipe 115 that allows the compressed refrigerant to be discharged from the linear compressor 100, and a supplementary pipe for supplementing the refrigerant in the linear compressor 100.

For example, the intake pipe 114 can be coupled to the first shell cover 112. The refrigerant can be suctioned into the linear compressor 100 along the axial direction through the intake pipe 114, and the refrigerant suctioned into the linear compressor 100 can be compressed while flowing in the axial direction.

The discharge pipe 115 can be coupled to an outer circumferential surface of the shell 111. The compressed refrigerant in the linear compressor 100 can be discharged through the discharge pipe 115. The discharge pipe 115 can be disposed closer to the second shell cover 113 than to the first shell cover 112.

The supplementary pipe can be coupled to the outer circumferential surface of the shell 111. A worker can inject the refrigerant into the linear compressor 100 through the supplementary pipe.

The supplementary pipe can be coupled to the shell 111 at a different height from the discharge pipe 115 in order to prevent interference with the discharge pipe 115. Herein, the height can be understood as a distance measured from the leg in a vertical direction. Because the discharge pipe 115 and the supplementary pipe are coupled to the outer circumferential surface of the shell 111 at different heights, the work convenience can be attained.

On an inner circumferential surface of the shell 111 corresponding to a location at which the supplementary pipe is coupled, at least a portion of the second shell cover 113 can be positioned adjacently. In other words, at least a portion of the second shell cover 113 can act as a resistance of the refrigerant injected through the supplementary pipe.

Thus, with respect to a flow path of the refrigerant, a size of the flow path of the refrigerant introduced through the supplementary pipe can decrease by the second shell cover 113 while the refrigerant enters into the inner space of the shell 111, and increase again after the refrigerant passes through a part of the second shell cover 113.

In this process, a pressure of the refrigerant can be reduced to vaporize the refrigerant, and an oil contained in the refrigerant can be separated. Thus, while the refrigerant, from which the oil is separated, is introduced into the piston 150, a compression performance of the refrigerant can be improved. The oil can be understood as a working oil present in a cooling system.

The linear compressor 100 can be a component of a refrigeration cycle, and a fluid compressed in the linear compressor can be a refrigerant circulating the refrigeration cycle.

The refrigeration cycle can include a condenser, an expander, an evaporator, etc., in addition to the linear compressor. The linear compressor can be used as a component of a cooling system of a refrigerator, but is not limited thereto. The linear compressor can be widely used in the whole industry.

The linear compressor 100 can include a casing 110 and a main body accommodated in the casing 110.

The main body of the linear compressor 100 can include a frame 120, the cylinder 140 fixed to the frame 120, the piston 150 that linearly reciprocates inside the cylinder 140, the drive unit 130 that is fixed to the frame 120 and gives a driving force to the piston 150, and the like.

Here, the cylinder 140 and the piston 150 can be referred to as compression units 140 and 150.

The linear compressor 100 can include a bearing means for reducing a friction between the cylinder 140 and the piston 150. For example, the bearing means can include an oil bearing or a gas bearing. Alternatively, a mechanical bearing can be used as the bearing means.

The main body of the linear compressor 100 can be elastically supported by support springs 116 and 117 installed at both ends in the casing 110.

The support springs 116 and 117 can include a first support spring 116 supporting the rear of the main body and a second support spring 117 supporting a front of the main body.

The support springs 116 and 117 can include a leaf spring. The support springs 116 and 117 can absorb vibrations and impacts generated by a reciprocating motion of the piston 150 while supporting the internal components of the main body of the linear compressor 100.

The casing 110 can define a sealed space. The sealed space can include an accommodation space 101 in which the suctioned refrigerant is accommodated, an intake space 102 which is filled with the refrigerant before the compression, a compression space 103 in which the refrigerant is compressed, and a discharge space 104 which is filled with the compressed refrigerant.

The refrigerant suctioned from the intake pipe 114 connected to the rear side of the casing 110 can be filled in the accommodation space 101. After the refrigerant in the intake space 102 communicating with the accommodation space 101 is compressed in the compression space 103 and is discharged into the discharge space 104, the refrigerant can be discharged to the outside through the discharge pipe 115 connected to the front side of the casing 110.

The casing 110 can include the shell 111 formed in a substantially cylindrical shape that is open at both ends and is long in a transverse direction, the first shell cover 112 coupled to the rear side of the shell 111, and the second shell cover 113 coupled to the front side of the shell 111.

Here, it can be understood that the front side is the left side of the drawing and is a direction in which the compressed refrigerant is discharged, and the rear side is the right side of the drawing and is a direction in which the refrigerant is introduced.

Further, the first shell cover 112 and the second shell cover 113 can be formed as one body with the shell 11.

The casing 110 can be formed of a thermally conductive material. Hence, heat generated in the inner space of the casing 110 can be quickly dissipated to the outside.

The first shell cover 112 can be coupled to the shell 111 in order to seal the rear side of the shell 111, and the intake pipe 114 can be inserted and coupled to the center of the first shell cover 112.

The rear side of the main body of the linear compressor 100 can be elastically supported by the first support spring 116 in the radial direction of the first shell cover 112.

The first support spring 116 can include a circular leaf spring. An edge portion of the first support spring 116 can be elastically supported by a support bracket 123*a* in a forward direction with respect to a back cover 123.

An opened center portion of the first support spring 116 can be supported by an intake guide 116*a* in a rearward direction with respect to the first shell cover 112.

A through passage can be formed inside the intake guide 116*a*. The intake guide 116*a* can be formed in a cylindrical shape.

A front outer circumferential surface of the intake guide 116*a* can be coupled to a central opening of the first support spring 116, and a rear end of the intake guide 116*a* can be supported by the first shell cover 112. In this instance, a separate intake support member 116*b* can be interposed between the intake guide 116*a* and an inner surface of the first shell cover 112.

A rear side of the intake guide 116*a* can communicate with the intake pipe 114, and the refrigerant suctioned through the intake pipe 114 can pass through the intake guide 116*a* and can be smoothly introduced into a muffler unit 160 to be described below.

A damping member 116*c* can be disposed between the intake guide 116*a* and the intake support member 116*b*. The damping member 116*c* can be formed of a rubber material or the like. Hence, a vibration that can occur in the process of suctioning the refrigerant through the intake pipe 114 can be prevented from being transmitted to the first shell cover 112.

The second shell cover 113 can be coupled to the shell 111 to seal the front side of the shell 111. The discharge pipe 115 can be inserted into the second shell cover 113 through a loop pipe 115*a* and coupled.

The refrigerant discharged from the compression space 103 can pass through a discharge cover assembly 180 and then can be discharged into the refrigeration cycle through the loop pipe 115*a* and the discharge pipe 115.

A front side of the main body of the compressor 100 can be elastically supported by the second support spring 117 in the radial direction of the shell 111 or the second shell cover 113.

The second support spring 117 can include a circular leaf spring. An opened center portion of the second support spring 117 can be supported by a first support guide 117*b* in a rearward direction with respect to the discharge cover assembly 180.

An edge of the second support spring 117 can be supported by a support bracket 117*a* in a forward direction with respect to an inner surface of the shell 111 or the inner circumferential surface of the shell 111 adjacent to the second shell cover 113.

Unlike FIG. 1, the edge of the second support spring 117 can be supported in the forward direction with respect to the inner surface of the shell 111 or the inner circumferential surface of the shell 111 adjacent to the second shell cover 113 through a separate bracket coupled to the second shell cover 113.

The first support guide 117*b* can be formed in a cylindrical shape. A cross section of the first support guide 117*b* can have a plurality of diameters.

A front side of the first support guide 117*b* can be inserted into a central opening of the second support spring 117, and a rear side of the first support guide 117*b* can be connected to the discharge cover assembly 180.

A support cover 117*c* can be coupled to the front side of the first support guide 117*b* with the second support spring 117 interposed therebetween. A cup-shaped second support guide 117*d* that is recessed forward can be coupled to the front side of the support cover 117*c*.

A cup-shaped third support guide 117*e* that corresponds to the second support guide 117*d* and is recessed rearward can be coupled to the inside of the second shell cover 113.

The second support guide 117*d* can be inserted into the third support guide 117*e* and can be supported in the axial direction and/or the radial direction. In this instance, a gap can be formed between the second support guide 117*d* and the third support guide 117*e*.

The frame 120 can include a body portion 121 supporting the outer circumferential surface of the cylinder 140, and a first flange portion 122 that is connected to one side of the body portion 121 and supports the drive unit 130. The frame 120 can be elastically supported with respect to the casing 110 by the first and second support springs 116 and 117 together with the drive unit 130 and the cylinder 140.

The body portion 121 can surround the outer circumferential surface of the cylinder 140. The body portion 121 can be formed in a cylindrical shape. The first flange portion 122 can extend from a front end of the body portion 121 in the radial direction.

The cylinder 140 can be coupled to an inner circumferential surface of the body portion 121. An inner stator 134 can be coupled to an outer circumferential surface of the body portion 121.

For example, the cylinder 140 can be pressed and fitted to the inner circumferential surface of the body portion 121, and the inner stator 134 can be fixed to the outer circumferential surface of the body portion 121 using a separate fixing ring.

An outer stator 131 can be coupled to a rear surface of the first flange portion 122, and the discharge cover assembly 180 can be coupled to a front surface of the first flange portion 122.

For example, the outer stator 131 and the discharge cover assembly 180 can be fixed through a mechanical coupling means.

A bearing inlet groove 125*a* forming a part of the gas bearing can be formed on one side of the front surface of the first flange portion 122. A first bearing communication hole 125*b* penetrating from the bearing inlet groove 125*a* to the inner circumferential surface of the body portion 121 can be formed in the body portion 121. A gas groove 125*c* communicating with the first bearing communication hole 125*b* can be formed on the inner circumferential surface of the body portion 121.

The bearing inlet groove 125*a* can be recessed to a predetermined depth along the axial direction. The first bearing communication hole 125*b* is a hole having a smaller cross-sectional area than the bearing inlet groove 125*a* and can be inclined toward the inner circumferential surface or the inside surface of the body portion 121.

The gas groove 125*c* can be formed in an annular shape having a predetermined depth and an axial length on the inner circumferential surface of the body portion 121. Alternatively, the gas groove 125*c* can be formed on the outer circumferential surface of the cylinder 140 in contact with the inner circumferential surface of the body portion 121, or formed on both the inner circumferential surface of the body portion 121 and the outer circumferential surface of the cylinder 140.

In addition, a gas inlet 142 corresponding to the gas groove 125*c* can be formed on the outer circumferential surface of the cylinder 140. The gas inlet 142 forms a kind of nozzle in the gas bearing.

The frame 120 and the cylinder 140 can be formed of aluminum or an aluminum alloy material.

The cylinder 140 can be formed in a cylindrical shape in which both ends are opened. The piston 150 can be inserted through a rear end of the cylinder 140. A front end of the cylinder 140 can be closed through a discharge valve assembly 170.

The compression space 103 can be formed between the cylinder 140, a front end of the piston 150, and the discharge valve assembly 170. Here, the front end of the piston 150 can be referred to as a head portion 151 or first side of the piston 150.

The volume of the compression space 103 increases when the piston 150 moves backward, and decreases as the piston 150 moves forward. That is, the refrigerant introduced into the compression space 103 can be compressed while the piston 150 moves forward, and can be discharged through the discharge valve assembly 170.

The cylinder 140 can include a second flange portion 141 disposed at the front end. The second flange portion 141 can bend to the outside of the cylinder 140. The second flange portion 141 can extend in an outer circumferential direction of the cylinder 140.

The second flange portion 141 of the cylinder 140 can be coupled to the frame 120. For example, the front end of the frame 120 can include a flange groove corresponding to the second flange portion 141 of the cylinder 140, and the second flange portion 141 of the cylinder 140 can be inserted into the flange groove and coupled through a coupling member.

An O-ring 124 can be formed between the frame 120 and the second flange portion 141 of the cylinder 140. The O-ring 124 seals a space between the frame 120 and the second flange portion 141 of the cylinder 140, and thus can prevent the refrigerant from leaking forward through the frame 120 and the second flange portion 141 of the cylinder 140.

The O-ring 124 can include a first O-ring 124*a* disposed at the rear of the second flange portion 141 of the cylinder 140 and a second O-ring 124*b* disposed in front of the second flange portion 141 of the cylinder 140.

A gas bearing means can be provided to supply some of a discharge refrigerant to a space between the outer circumferential surface of the piston 150 and the inner circumferential surface of the cylinder 140 and to lubricate between the cylinder 140 and the piston 150 with gas.

The discharge refrigerant supplied between the cylinder 140 and the piston 150 can provide a levitation force to the piston 150 to reduce a friction generated between the piston 150 and the cylinder 140.

For example, the cylinder 140 can include the gas inlet 142. The gas inlet 142 can communicate with the gas groove 125*c* formed on the inner circumferential surface of the body portion 121.

The gas inlet 142 can pass through the cylinder 140 in the radial direction. The gas inlet 142 can guide the compressed refrigerant introduced in the gas groove 125*c* between the inner circumferential surface of the cylinder 140 and the outer circumferential surface of the piston 150.

Alternatively, the gas groove 125*c* can be formed on the outer circumferential surface of the cylinder 140 in consideration of the convenience of processing.

An entrance of the gas inlet 142 can be formed relatively widely, and an exit of the gas inlet 142 can be formed as a fine through hole to serve as a nozzle. The entrance of the gas inlet 142 can further include a filter configured to block the inflow of foreign matter. The filter can be a metal mesh filter, or can be formed by winding a member such as fine thread.

The plurality of gas inlets 142 can be independently formed. The gas inlet 142 can be formed only at the front side based on the axial direction center of the cylinder 140. Unlike this, the gas inlet 142 can be formed at the rear side based on the axial direction center of the cylinder 140 in consideration of the sagging of the piston 150.

The piston 150 is inserted into the opened rear end of the cylinder 140 and is installed to seal the rear of the compression space 103.

The piston 150 can include a head portion 151 and a guide portion 152. The head portion 151 can be formed in a disc shape. The head portion 151 can be partially open. The head portion 151 can partition the compression space 103.

The guide portion 152 can extend rearward from an outer circumferential surface of the head portion 151. The guide portion 152 can be formed in a cylindrical shape. The inside of the guide portion 152 can be empty, and a front of the guide portion 152 can be partially sealed by the head portion 151.

A rear of the guide portion 152 can be opened and connected to the muffler unit 160. The head portion 151 can be provided as a separate member coupled to the guide portion 152. Alternatively, the head portion 151 and the guide portion 152 can be formed as one body.

The piston 150 can include an intake port 154. The intake port 154 can pass through the head portion 151. The intake port 154 can communicate with the intake space 102 and the compression space 103 inside the piston 150.

For example, the refrigerant flowing from the accommodation space 101 to the intake space 102 in the piston 150 can pass through the intake port 154 and can be suctioned into the compression space 103 between the piston 150 and the cylinder 140.

The intake port 154 can extend in the axial direction of the piston 150. The intake port 154 can be inclined in the axial direction of the piston 150. For example, the intake port 154 can extend to be inclined in a direction away from the central axis as it goes to the rear of the piston 150.

A cross section of the intake port 154 can be formed in a circular shape. The intake port 154 can have a constant inner diameter. In contrast, the intake port 154 can be formed as a long hole in which an opening extends in the radial direction of the head portion 151, or can be formed such that the inner diameter becomes larger as it goes to the rear.

The plurality of intake ports 154 can be formed in at least one of the radial direction and the circumferential direction of the head portion 151.

The head portion 151 of the piston 150 adjacent to the compression space 103 can be equipped with an intake valve 155 for selectively opening and closing the intake port 154. The intake valve 155 can operate by elastic deformation to open or close the intake port 154.

That is, the intake valve 155 can be elastically deformed to open the intake port 154 by the pressure of the refrigerant flowing into the compression space 103 through the intake port 154. The intake valve 155 can be a lead valve, but is not limited thereto and can be variously changed.

The piston 150 can be connected to a mover 135. The mover 135 can reciprocate forward and backward according to the movement of the piston 150. The inner stator 134 and the cylinder 140 can be disposed between the mover 135 and the piston 150.

The mover 135 and the piston 150 can be connected to each other by a magnet frame 136 that is formed by detouring the cylinder 140 and the inner stator 134 to the rear.

The muffler unit 160 can be coupled to the rear of the piston 150 to reduce a noise generated in the process of suctioning the refrigerant into the piston 150. The refrigerant suctioned through the intake pipe 114 can flow into the intake space 102 in the piston 150 via the muffler unit 160.

The muffler unit 160 can include an intake muffler 161 communicating with the accommodation space 101 of the casing 110, and an inner guide 162 that is connected to a front of the intake muffler 161 and guides the refrigerant to the intake port 154.

The intake muffler 161 can be positioned behind the piston 150. A rear opening of the intake muffler 161 can be disposed adjacent to the intake pipe 114, and a front end of the intake muffler 161 can be coupled to the rear of the piston 150.

The intake muffler 161 can have a flow path formed in the axial direction and guide the refrigerant in the accommodation space 101 to the intake space 102 inside the piston 150.

The inside of the intake muffler 161 can include a plurality of noise spaces partitioned by a baffle. The intake muffler 161 can be formed by combining two or more members. For example, a second intake muffler can be press-coupled to the inside of a first intake muffler to form a plurality of noise spaces. In addition, the intake muffler 161 can be formed of a plastic material in consideration of weight or insulation property.

One side of the inner guide 162 can communicate with the noise space of the intake muffler 161, and other side of the inner guide 162 can be deeply inserted into the piston 150. The inner guide 162 can be formed in a pipe shape. Both ends of the inner guide 162 can have the same inner diameter. The inner guide 162 can be formed in a cylindrical shape. Alternatively, an inner diameter of a front end that is a discharge side of the inner guide 162 can be greater than an inner diameter of a rear end opposite the front end.

The intake muffler 161 and the inner guide 162 can be provided in various shapes and can adjust the pressure of the refrigerant passing through the muffler unit 160. The intake muffler 161 and the inner guide 162 can be formed as one body.

The discharge valve assembly 170 can include a discharge valve 171, a valve spring 172 that is provided on a front side of the discharge valve 171 and elastically supports the discharge valve 171, and a spring support member 173 that is coupled to the discharge cover assembly 180 and supports the valve spring 172.

The discharge valve assembly 170 can selectively discharge the compressed refrigerant in the compression space 103. Here, the compression space 103 means a space between the intake valve 155 and the discharge valve 171.

The discharge valve 171 can be disposed to be supportable on the front surface of the cylinder 140. The discharge valve 171 can selectively open and close the front opening of the cylinder 140.

The discharge valve 171 can operate by elastic deformation to open or close the compression space 103. The discharge valve 171 can be elastically deformed to open the compression space 103 by the pressure of the refrigerant flowing into the discharge space 104 through the compression space 103.

For example, the compression space 103 can maintain a sealed state while the discharge valve 171 is supported on the front surface of the cylinder 140, and the compressed refrigerant of the compression space 103 can be discharged into the discharge space 104 in a state where the discharge valve 171 is spaced apart from the front surface of the cylinder 140.

The discharge valve 171 can be a lead valve, but is not limited thereto.

The valve spring 172 can be provided between the discharge valve 171 and the discharge cover assembly 180 to provide an elastic force in the axial direction.

The valve spring 172 can be provided as a compression coil spring, and can be provided as a leaf spring in consideration of an occupied space or reliability.

When the pressure of the compression space 103 is equal to or greater than a discharge pressure, the valve spring 172 can open the discharge valve 171 while deforming forward, and the refrigerant can be discharged from the compression space 103 and discharged into a first discharge space **104*a* of the discharge cover assembly 180. When the discharge of the refrigerant is completed, the valve spring 172 provides a restoring force to the discharge valve 171 and thus can allow the discharge valve 171** to be closed.

A process of introducing the refrigerant into the compression space 103 through the intake valve 155 and discharging the refrigerant of the compression space 103 into the discharge space 104 through the discharge valve 171 is described as follows.

In the process in which the piston 150 linearly reciprocates in the cylinder 140, when the pressure of the compression space 103 is equal to or less than a predetermined intake pressure, the intake valve 155 is opened and thus the refrigerant is suctioned into a compression space 103.

On the other hand, when the pressure of the compression space 103 exceeds the predetermined intake pressure, the refrigerant of the compression space 103 is compressed in a state in which the intake valve 155 is closed.

In the process in which the piston 150 linearly reciprocates in the cylinder 140, when the pressure of the compression space 103 is equal to or greater than a predetermined discharge pressure, the valve spring 172 opens the discharge valve 171 connected to the valve spring 172 while deforming forward, and the refrigerant is discharged from the compression space 103 to the discharge space 104 of the discharge cover assembly 180.

When the discharge of the refrigerant is completed, the discharge valve 171 is closed by the valve spring 172, and a front of the compression space 103 is sealed.

The drive unit 130 can include the outer stator 131 that is disposed between the shell 111 and the frame 120 and surrounds the body portion 121 of the frame 120, the inner stator 134 that is disposed between the outer stator 131 and the cylinder 140 and surrounds the cylinder 140, and the mover 135 disposed between the outer stator 131 and the inner stator 134.

The outer stator 131 can be coupled to the rear of the first flange portion 122 of the frame 120, and the inner stator 134 can be coupled to the outer circumferential surface of the body portion 121 of the frame 120.

The inner stator 134 can be spaced apart from the inside of the outer stator 131, and the mover 135 can be disposed in a space between the outer stator 131 and the inner stator 134.

The outer stator 131 can be equipped with a winding coil, and the mover 135 can include a permanent magnet.

The permanent magnet can be comprised of a single magnet with one pole or configured by combining a plurality of magnets with three poles.

The outer stator 131 can include a coil winding body 132 surrounding the axial direction in the circumferential direction, and a stator core 133 stacked while surrounding the coil winding body 132.

The coil winding body 132 can include a hollow cylindrical bobbin 132*a* and a coil 132*b* wound in a circumferential direction of the bobbin 132*a*.

A cross section of the coil 132*b* can be formed in a circular or polygonal shape and, for example, can have a hexagonal shape.

The stator core 133 can be configured such that a plurality of lamination sheets are laminated radially, and can also be configured such that a plurality of lamination blocks are laminated along the circumferential direction.

The front side of the outer stator 131 can be supported by the first flange portion 122 of the frame 120, and the rear side of the outer stator 131 can be supported by a stator cover 137.

The stator cover 137 can be formed in a hollow disc shape. The outer stator 131 can be supported on a front surface of the stator cover 137, and a resonant spring 118 can be supported on a rear surface of the stator cover 137.

The inner stator 134 can be configured such that a plurality of lamination sheets or a plurality of lamination blocks are laminated on the outer circumferential surface of the body portion 121 of the frame 120 in the circumferential direction.

One side of the mover 135 can be coupled to and supported by the magnet frame 136. The magnet frame 136 can have a substantially cylindrical shape and can be disposed to be inserted into a space between the outer stator 131 and the inner stator 134. The magnet frame 136 can be coupled to the rear side of the piston 150 and installed so that the magnet frame 136 moves together with the piston 150.

A rear end of the magnet frame 136 is bent and extended inward in the radial direction to form a first coupling portion 136*a*, and the first coupling portion 136*a* can be coupled to a third flange portion 153 formed behind the piston 150.

The first coupling portion 136*a* of the magnet frame 136 and the third flange portion 153 of the piston 150 can be coupled through a mechanical coupling member.

A fourth flange portion 161*a* formed in front of the intake muffler 161 can be interposed between the third flange portion 153 of the piston 150 and the first coupling portion 136*a* of the magnet frame 136.

Thus, the piston 150, the muffler unit 160, and the mover 135 can linearly reciprocate together in a combined state.

When a current is applied to the drive unit 130, a magnetic flux can be formed in the winding coil, and an electromagnetic force can occur by an interaction between the magnetic flux formed in the winding coil of the outer stator 131 and a magnetic flux formed by the permanent magnet of the mover 135 to move the mover 135.

In addition, when the mover 135 reciprocates axially, the piston 150 connected to the magnet frame 136 can axially reciprocate integrally with the mover 135.

The drive unit 130 and the compression units 140 and 150 can be axially supported by the support springs 116 and 117 and the resonant spring 118.

The resonant spring 118 amplifies the vibration implemented by the reciprocating motion of the mover 135 and the piston 150 and thus can achieve an effective compression of the refrigerant.

More specifically, the resonant spring 118 can be adjusted to a frequency corresponding to a natural frequency of the piston 150 and can allow the piston 150 to perform a resonant motion. Further, the resonant spring 118 generates a stable movement of the piston 150 and thus can reduce the generation of vibration and noise.

The resonant spring 118 can be a coil spring extending in the axial direction. Both ends of the resonant spring 118 can be connected to a vibrating body and a fixed body, respectively. For example, one end of the resonant spring 118 can be connected to the magnet frame 136, and the other end of the resonant spring 118 can be connected to the back cover 123.

Therefore, the resonant spring 118 can be elastically deformed between the vibrating body vibrating at one end and the fixed body fixed to the other end.

A natural frequency of the resonant spring 118 can be designed to match a resonant frequency of the mover 135 and the piston 150, thereby amplifying the reciprocating motion of the piston 150.

However, because the back cover 123 provided as the fixing body is elastically supported by the first support spring 116 in the casing 110, the back cover 123 may not be strictly fixed.

The resonant spring 118 can include a first resonant spring 118*a* supported on the rear side based on a spring supporter 119 and a second resonant spring 118*b* supported on the front side based on a spring supporter 119.

The spring supporter 119 can include a body portion 119*a* surrounding the intake muffler 161, a second coupling portion 119*b* that is bent from a front of the body portion 119*a* in the inward radial direction, and a support portion 119*c* that is bent from the rear of the body portion 119*a* in the outward radial direction.

A front surface of the second coupling portion 119*b* of the spring supporter 119 can be supported by the first coupling portion 136*a* of the magnet frame 136. An inner diameter of the second coupling portion 119*b* of the spring supporter 119 can surround an outer diameter of the intake muffler 161.

For example, the second coupling portion 119*b* of the spring supporter 119, the first coupling portion 136*a* of the magnet frame 136, and the third flange portion 153 of the piston 150 can be sequentially disposed and then integrally coupled through a mechanical member.

In this instance, the description, that the fourth flange portion 161*a* of the intake muffler 161 can be interposed between the third flange portion 153 of the piston 150 and the first coupling portion 136*a* of the magnet frame 136 and they can be fixed together, is the same as that described above.

The first resonant spring 118*a* can be disposed between a front surface of the back cover 123 and a rear surface of the spring supporter 119. The second resonant spring 118*b* can be disposed between a rear surface of the stator cover 137 and a front surface of the spring supporter 119.

The plurality of first and second resonant springs 118*a* and 118*b* can be disposed. The first resonant springs 118*a* and the second resonant springs 118*b* can be disposed parallel to each other in the axial direction, or can be alternately disposed.

The first and second resonant springs 118*a* and 118*b* can be disposed at regular intervals in the radial direction of the central axis. For example, three first resonant springs 118*a* and three second resonant springs 118*b* can be provided and can be disposed at intervals of 120 degrees in the radial direction of the central axis.

The linear compressor 100 can include a sealing member capable of increasing a coupling force between the frame 120 and the components around the frame 120. For example, the sealing member can be inserted into an installation groove provided on the outer surface of the frame 120 and can be installed at a portion in which the frame 120 and the inner stator 134 are coupled. The sealing member can have a ring shape.

An operation of the linear compressor 100 described above is as follows.

First, when a current is applied to the drive unit 130, a magnetic flux can be formed in the outer stator 131 by the current flowing in the coil 132*b*.

The magnetic flux formed in the outer stator 131 can generate an electromagnetic force, and the mover 135 including the permanent magnet can linearly reciprocate by the generated electromagnetic force.

The electromagnetic force can be generated in a direction (forward direction) in which the piston 150 is directed toward a top dead center (TDC) during a compression stroke, and can be generated in a direction (rearward direction) in which the piston 150 is directed toward a bottom dead center (BDC) during an intake stroke.

That is, the drive unit 130 can generate a thrust which is a force for pushing the mover 135 and the piston 150 in a moving direction.

The piston 150 linearly reciprocating inside the cylinder 140 can repeatedly increase or reduce the volume of the compression space 103.

When the piston 150 moves in a direction (rearward direction) of increasing the volume of the compression space 103, a pressure of the compression space 103 can decrease.

Hence, the intake valve 155 mounted in front of the piston 150 is opened, and the refrigerant remaining in the intake space 102 can be suctioned into the compression space 103 through the intake port 154.

The intake stroke can be performed until the piston 150 is positioned in the bottom dead center by maximally increasing the volume of the compression space 103.

The piston 150 reaching the bottom dead center can perform the compression stroke while moving in a direction (forward direction) of reducing the volume of the compression space 103.

While the pressure of the compression space 103 increases during the compression stroke, the refrigerant of the compression space 103 can be compressed.

When the pressure of the compression space 103 reaches a setting pressure, the discharge valve 171 can be pushed out by the pressure of the compression space 103 and can be opened from the cylinder 140, and the refrigerant of the compression space 103 can be discharged into the discharge space 104.

The compression stroke can continue while the piston 150 moves to the top dead center at which the volume of the compression space 103 is minimized.

As the intake stroke and the compression stroke of the piston 150 are repeated, the refrigerant introduced into the accommodation space 101 inside the compressor 100 through the intake pipe 114 can be introduced into the intake space 102 in the piston 150 by sequentially passing the intake guide 116*a*, the intake muffler 161, and the inner guide 162, and the refrigerant of the intake space 102 can be introduced into the compression space 103 in the cylinder 140 during the intake stroke of the piston 150.

After the refrigerant of the compression space 103 is compressed and discharged into the discharge space 104 during the compression stroke of the piston 150, the refrigerant can be discharged to the outside of the linear compressor 100 via the loop pipe 115*a* and the discharge pipe 115.

The discharge cover assembly 180 of the linear compressor 100 can include a discharge cover 185, a first discharge plenum 181, and a second discharge plenum 183. The discharge valve assembly 170 can include the discharge valve 171, the valve spring 172, and the spring support member 173.

The discharge cover assembly 180 is installed in front of the compression space 103 to form the discharge space 104 accommodating the refrigerant discharged from the compression space 103 and is coupled to the front of the frame 120, thereby attenuating noise generated in the process of discharging the refrigerant from the compression space 103.

The discharge cover assembly 180 can be coupled to the front of the first flange portion 122 of the frame 120.

The discharge cover assembly 180 can accommodate the discharge valve assembly 170. For example, the spring support member 173 of the discharge valve assembly 170 can be coupled to an inner rear area of the first discharge plenum 181 of the discharge cover assembly 180.

The discharge cover assembly 180 can include the discharge cover 185. The discharge cover 185 can be formed in a shape with an opened rear. The discharge cover 185 can be coupled to the frame 120.

A rear surface of the discharge cover 185 can be coupled to a front surface of the first flange portion 122 of the frame 120, and a sealing member 190 can be disposed between the discharge cover 185 and the frame 120.

An inner space can be formed in a space between an inner surface of the discharge cover 185, an inner surface of the frame 120, and the piston 150.

The first discharge plenum 181, the second discharge plenum 183, the discharge valve assembly 170, a fixing ring 188, and a damper 189 can be disposed in an inner space of the discharge cover 185.

The first discharge plenum 181 can be disposed inside the discharge cover 185. The first discharge plenum 181 can include a plurality of partition walls for partitioning the inner space of the discharge cover 185 into a plurality of discharge spaces 104*a*, 104*b*, and 104*c*. The first discharge plenum 181 can be disposed in front of the discharge valve assembly 170. The first discharge plenum 181 can be disposed behind the second discharge plenum 183.

The first discharge plenum 181 can be formed of an aluminum material.

The first discharge space 104*a* can selectively communicate with the compression space 103 by the discharge valve 171. The second discharge space 104*b* can communicate with the first discharge space 104*a*, and the third discharge space 104*c* can communicate with the second discharge space 104*b*.

Hence, as the refrigerant discharged from the compression space 103 sequentially passes through the first discharge space 104*a*, the second discharge space 104*b*, and the third discharge space 104*c*, a discharge noise can be attenuated. The refrigerant can be discharged to the outside of the casing 110 through the loop pipe 115*a* and the discharge pipe 115 communicating with the discharge cover 185.

The second discharge plenum 183 can be disposed inside the discharge cover 185. The second discharge plenum 183 can be disposed in front of the first discharge plenum 181.

In addition, the second discharge plenum 183 can be formed of an aluminum material. Through this, heat of the refrigerant passing through the plurality of discharge spaces 104*a*, 104*b*, and 104*c* can be prevented from being transferred to the discharge cover 185 through the second discharge plenum 183.

The fixing ring 188 can be disposed between the first discharge plenum 181 and the discharge valve assembly 170. The fixing ring 188 can be formed in an annular shape. The fixing ring 188 can be formed in a ring shape. The fixing ring 188 can be press-fitted between the spring support member 173 of the discharge valve assembly 170 and the first discharge plenum 181 to firmly fix the discharge valve assembly 170 inside the discharge cover assembly 180.

The damper 189 can be disposed between the first discharge plenum 181 and the discharge valve assembly 170. The damper 189 can prevent an axial vibration of the discharge valve assembly 170 from affecting the discharge cover assembly 180 when the piston 150 reciprocates axially.

The sealing member 190 can be disposed between the discharge cover assembly 180 and the frame 120. The sealing member 190 can prevent the refrigerant flowing inside the discharge cover assembly 180 from leaking into a space between the discharge cover assembly 180 and the frame 120.

The sealing member 190 can include a first sealing member 190*b*. The first sealing member 190*b* can be disposed between the discharge cover 185 and the first flange portion 122 of the frame 120.

The sealing member 190 can include a second sealing member 190*a*. The second sealing member 190*a* can be disposed between the discharge cover 185 and the frame 120. The second sealing member 190*a* can be formed in a circular ring shape.

Since the first and second discharge plenums can prevent a discharge refrigerant of a high temperature from directly contacting the discharge cover, the linear compressor having the above-described configuration has an effect of somewhat suppressing heat of the discharge refrigerant from being transferred to the discharge cover and the frame coupled to the discharge cover.

However, the linear compressor of FIG. 1 has a problem in that the rigidity is weak due to the simple structure of the discharge plenum.

There is also a problem in that the volume of discharge spaces formed by the discharge plenum is relatively large, and noise due to discharge pulsation is large.

Since the discharge plenum is coupled to the discharge cover by being simply inserted into or press-fitted to the discharge cover, there is a problem in that a hitting sound of the discharge valve, which is a main noise source of the linear compressor, may not be reduced.

One or more implementations of the present disclosure is described below with reference to FIGS. 2 to 12.

In some implementations, a discharge cover assembly according to the present disclosure can be applied instead of the discharge cover assembly of the linear compressor illustrated in FIG. 1.

Accordingly, hereinafter, the discharge cover assembly according to an implementation of the present disclosure is described in detail, and the description of other configurations of the linear compressor except for the discharge cover assembly is omitted.

In the description of an implementation of the present disclosure, the same reference numerals are given to the same components as the components of the linear compressor illustrated in FIG. 1, and a detailed description thereof is omitted.

Figure 2:
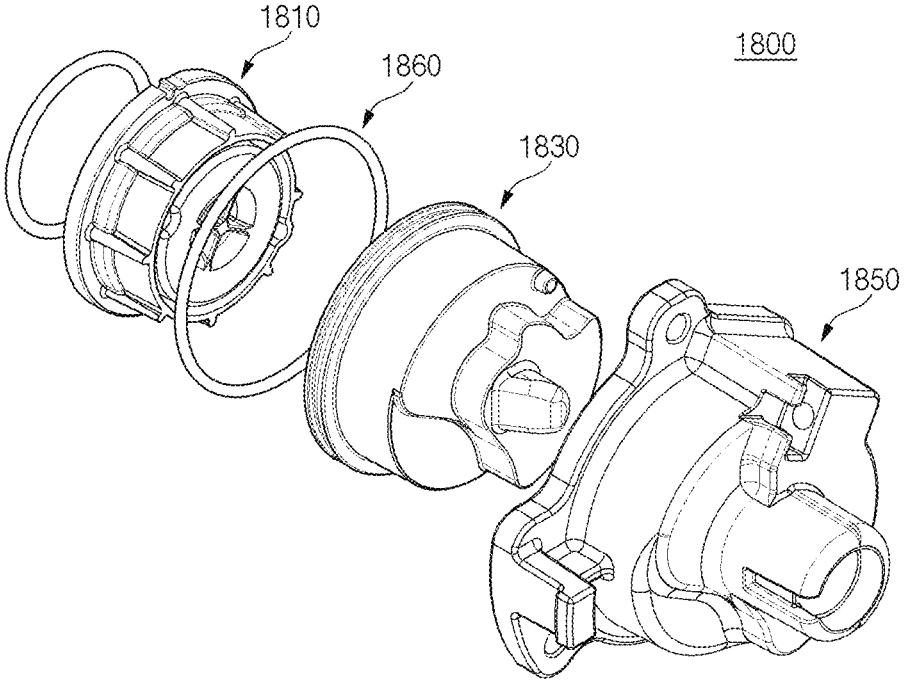
FIGS. 2 and 3 are exploded perspective views showing an example of a discharge cover assembly according to an implementations of the present disclosure.
Figure 3:
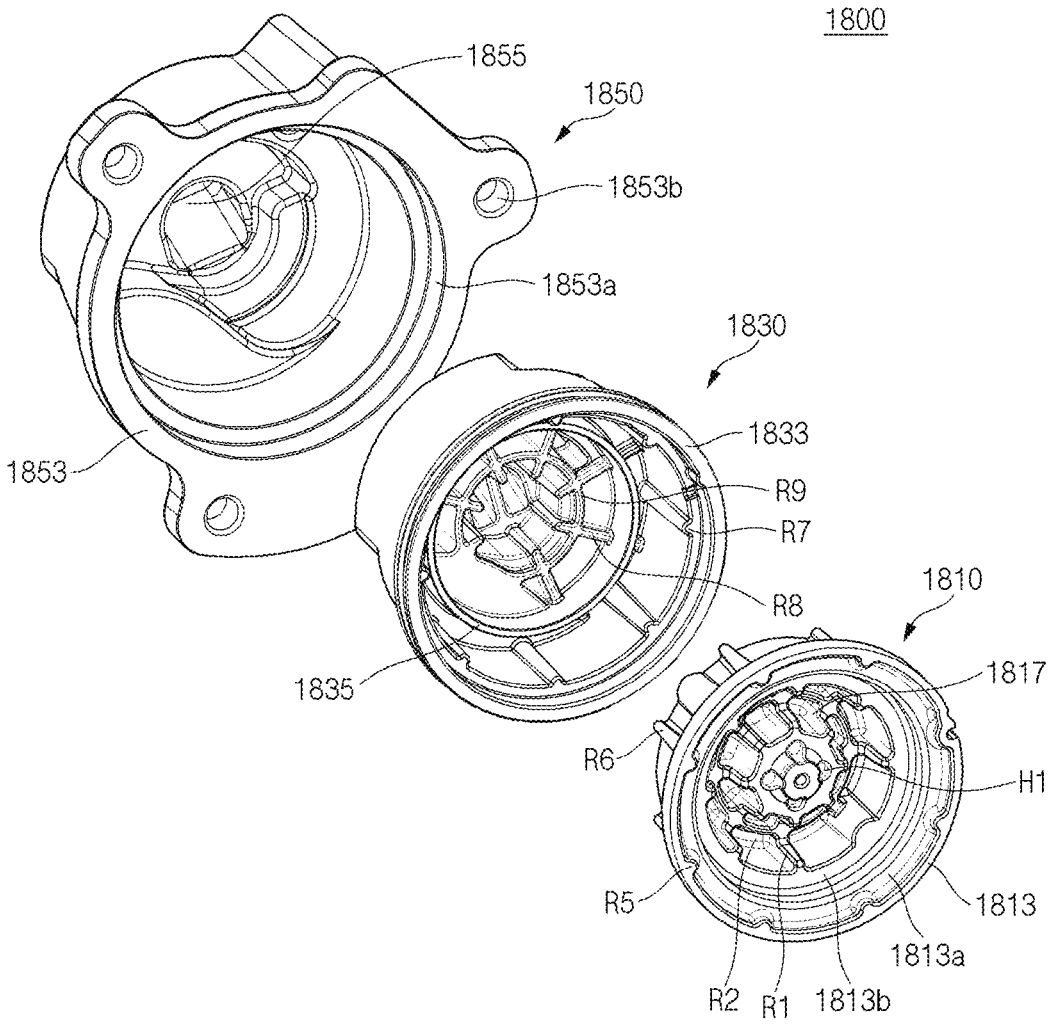

FIGS. 2 and 3 are exploded perspective views showing an example of a discharge cover assembly.

Figure 4:
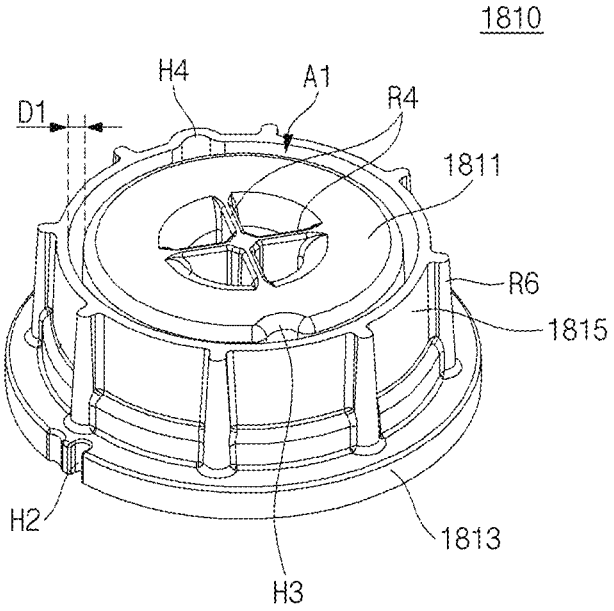
FIGS. 4 and 5 are perspective views showing an example of a first discharge plenum.
Figure 5:
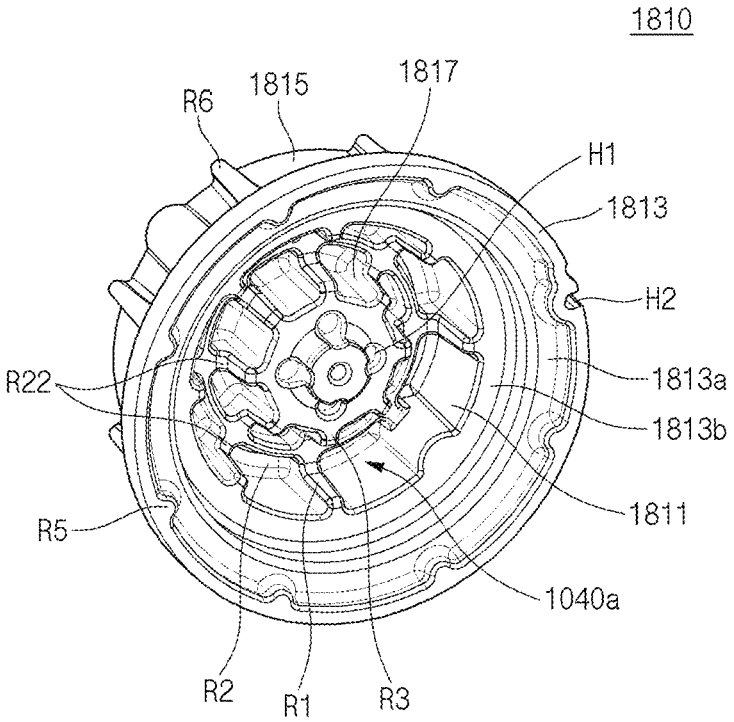

FIGS. 4 and 5 are perspective views showing an example of a first discharge plenum.

Figure 6:
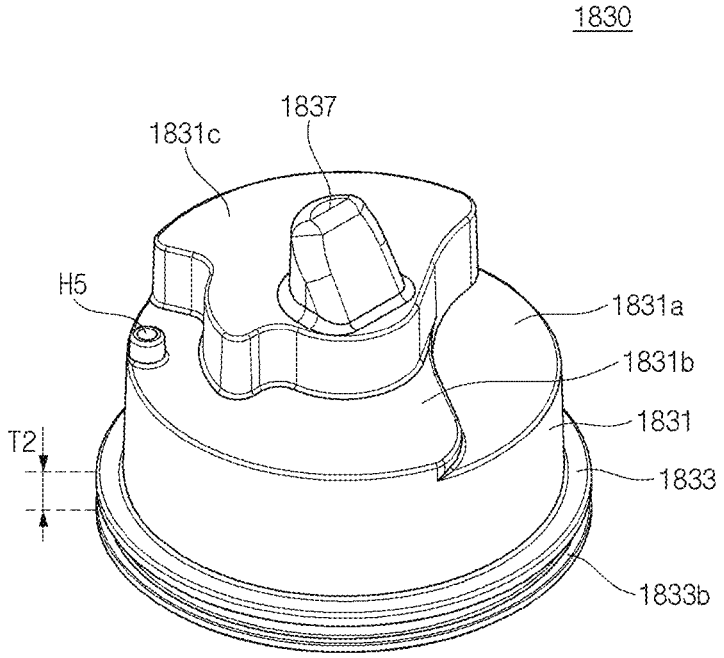
FIGS. 6 and 7 are perspective views showing an example of a second discharge plenum.
Figure 7:
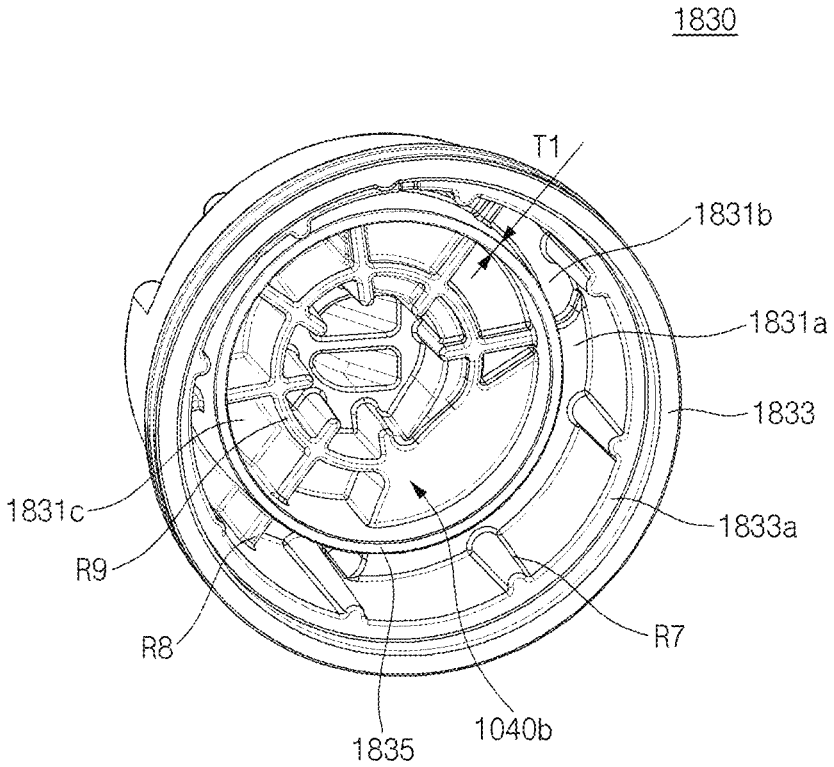

FIGS. 6 and 7 are perspective views showing an example of a second discharge plenum.

Figure 8:
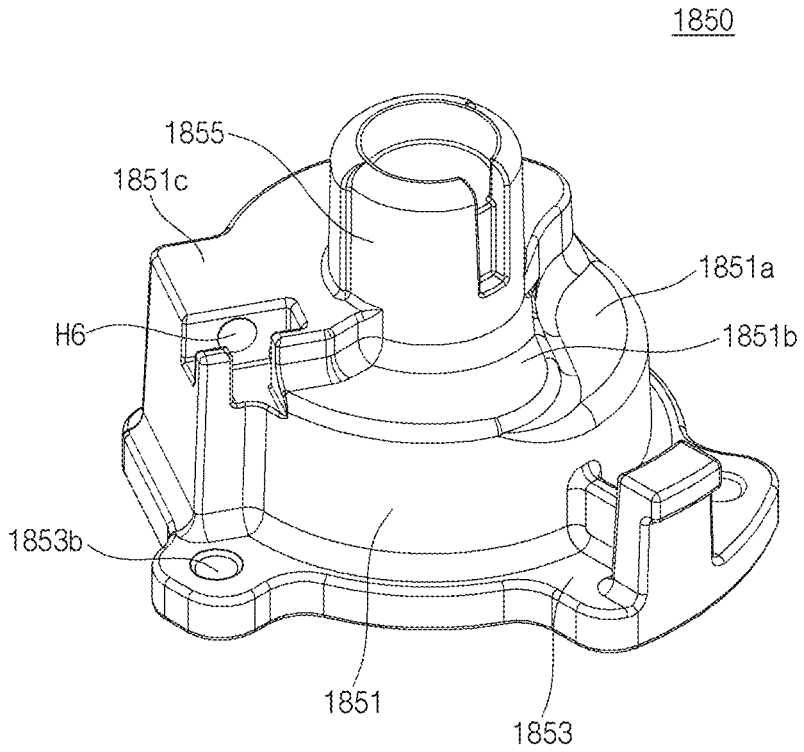
FIGS. 8 and 9 are perspective views showing an example of a discharge cover.
Figure 9:
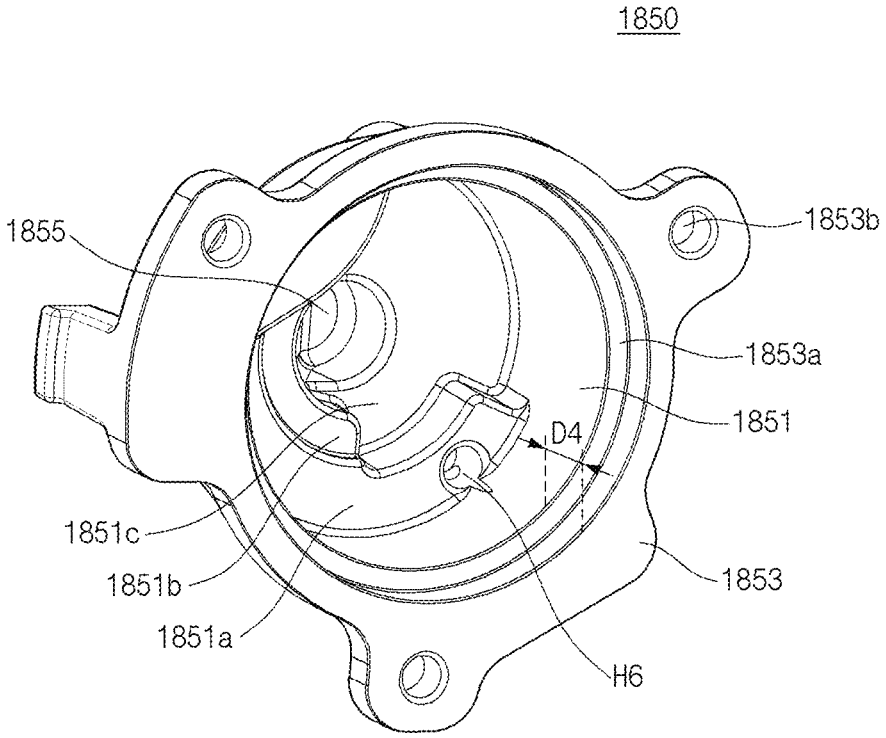

FIGS. 8 and 9 are perspective views showing an example of a discharge cover.

Figure 10:
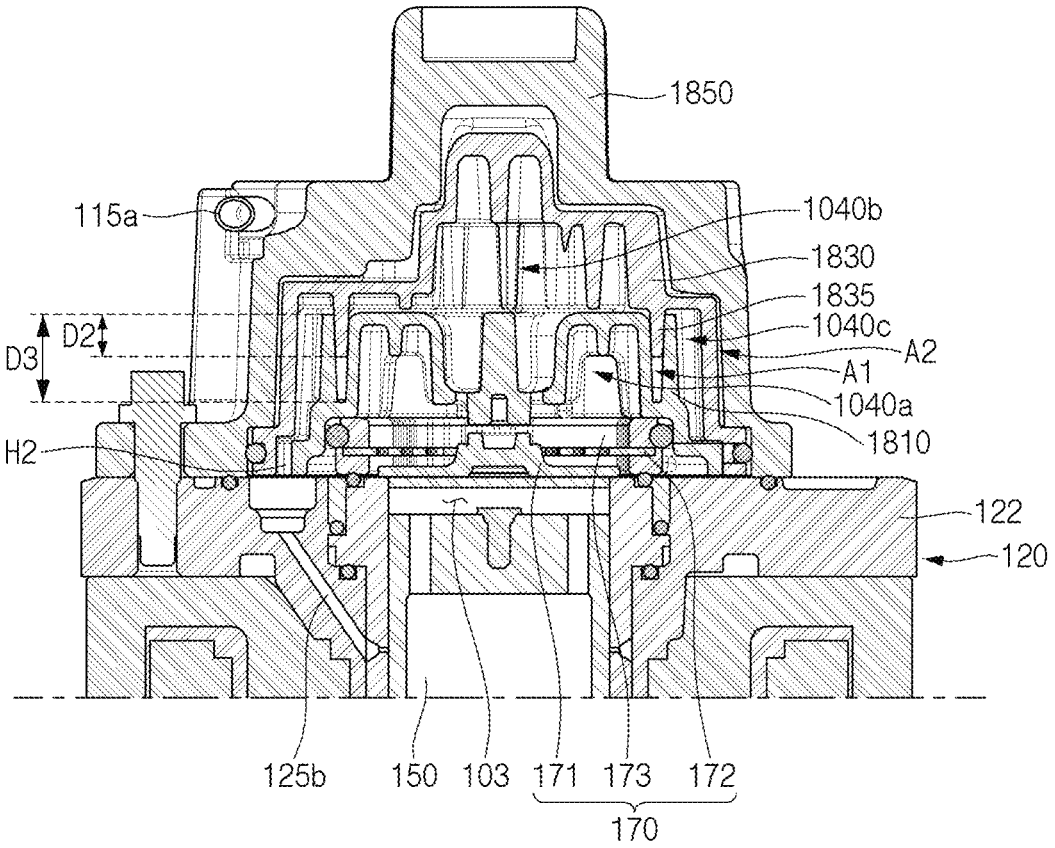
FIG. 10 is a cross-sectional view illustrating example components of a linear compressor.

FIG. 10 is a cross-sectional view illustrating example components of a linear compressor according to an implementation of the present disclosure.

Figure 11:
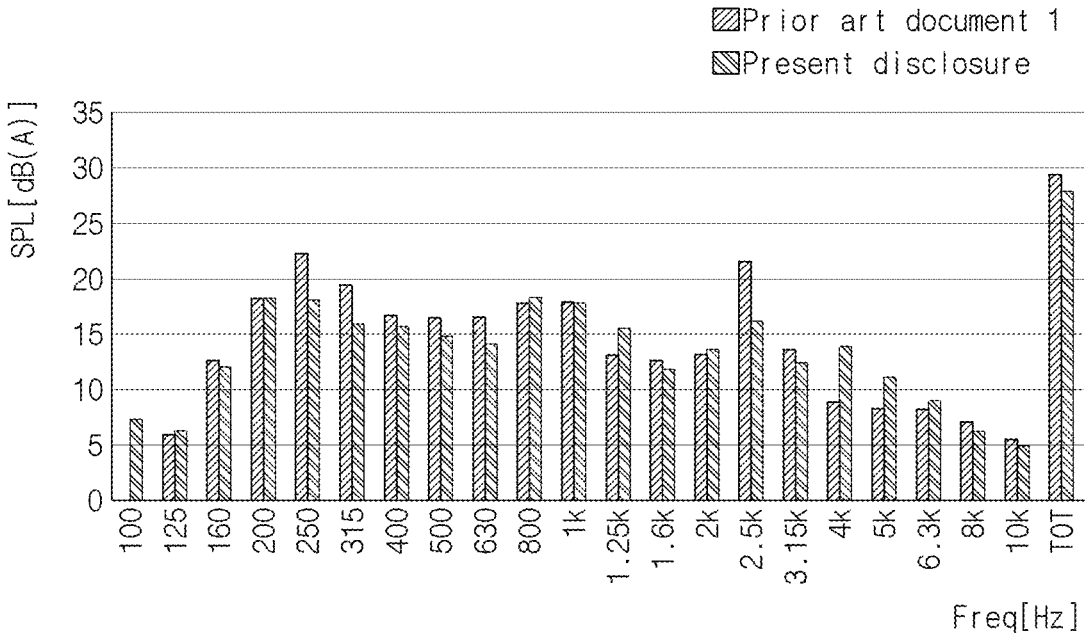
FIG. 11 is a graph comparing a noise measured at a rear of a refrigerator including a linear compressor of related art and a noise measured at a rear of a refrigerator including a linear compressor according to an implementations of the present disclosure.

FIG. 11 is a graph comparing a noise measured at a rear of a refrigerator including a linear compressor according to related art and a noise measured at a rear of a refrigerator including a linear compressor according to an implementation of the present disclosure.

Figure 12:
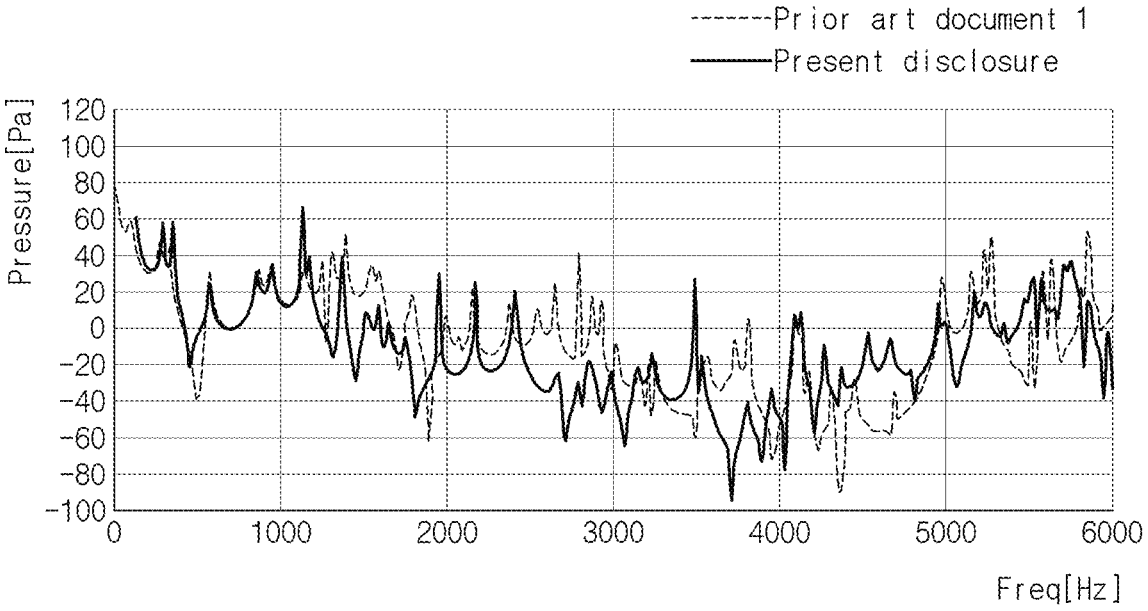
FIG. 12 is a graph comparing a pulsating component of a linear compressor of related art and a pulsating component of a linear compressor according to an implementation of the present disclosure.

FIG. 12 is a graph comparing a pulsating component of a linear compressor according to related art and a pulsating component of a linear compressor according to an implementation of the present disclosure.

In some implementations, a discharge cover assembly 1800 can include a first discharge plenum 1810, a second discharge plenum 1830, and a discharge cover 1850.

The discharge cover assembly 1800 can be coupled to a front of a first flange portion 122 of a frame 120. For example, the discharge cover assembly 1800 can be coupled to the first flange portion 122 through a mechanical coupling member.

The discharge cover assembly 1800 can accommodate a discharge valve assembly 170. For example, a spring support member 173 of the discharge valve assembly 170 can be coupled to an inner rear area of the first discharge plenum 1810 of the discharge cover assembly 1800.

The first discharge plenum 1810 can be disposed in an inner space of the discharge cover 1850. The first discharge plenum 1810 can be disposed in front of the discharge valve assembly 170. The first discharge plenum 1810 can be disposed behind the second discharge plenum 1830.

The first discharge plenum 1810 can be formed of a material, for example, polyamide 66 (PA66) having a heat transfer coefficient different from a heat transfer coefficient of a material forming the discharge cover 1850.

Since polyamide 66 has excellent mechanical strength and heat resistance, it is suitable as the material for the first discharge plenum 1810.

The first discharge plenum 1810 can be formed in a shape with an open rear. The first discharge plenum 1810 includes a first cylindrical body 1811 forming a first discharge space 1040*a* into which a refrigerant discharged through a discharge valve 171 is introduced, a first bottom portion 1813 supporting the first cylindrical body 1811, and a ring-shaped first wall 1815 that protrudes from the first bottom portion 1813 and surrounds the first cylindrical body 1811.

A first pillar 1817 is disposed in a central part of the first cylindrical body 1811. The first pillar 1817 protrudes rearward toward the discharge valve assembly 170 and has a predetermined depth. A plurality of first discharge holes H1 in a bottom surface of the first pillar 1817 pass through the bottom surface of the first pillar 1817 and discharge the refrigerant introduced through the discharge valve 171 into a second discharge space 1040*b* of the second discharge plenum 1830.

Accordingly, the first discharge space 1040*a* of the first discharge plenum 1810 and the second discharge space 1040*b* of the second discharge plenum 1830 communicate with each other by the plurality of first discharge holes H1.

The first bottom portion 1813 includes a first stepped portion 1813*a* and a second stepped portion 1813*b*. The first cylindrical body 1811 and the first pillar 1817 protrude toward the discharge cover 1850 at the second stepped portion 1813*b*.

A plurality of first reinforcement ribs R1 can be formed on an inner wall surface of the first cylindrical body 1811. The first reinforcement rib R1 protrudes from the inner wall surface of the first cylindrical body 1811 toward the first discharge space 1040*a* and elongates axially.

According to the above-described configuration, a strength of a wall surface of the first cylindrical body 1811 increases by the plurality of first reinforcement ribs R1.

A ring-shaped second reinforcement rib R2 protruding toward the first discharge space 1040*a* can be formed inside an upper surface of the first cylindrical body 1811.

According to the above-described configuration, a strength of the upper surface of the first cylindrical body 1811 increases by the second reinforcement rib R2.

A plurality of third reinforcement ribs R3 can be formed on an inner wall surface of the first pillar 1817. The third reinforcement rib R3 protrudes from the inner wall surface of the first pillar 1817 to the first discharge space 1040*a* and elongates axially.

According to the above-described configuration, a strength of the first pillar 1817 increases by the plurality of third reinforcement ribs R3.

A fourth reinforcement rib R4 is formed on an outer wall surface of the first pillar 1817 and spatially partitions the plurality of first discharge holes H1.

When the four first discharge holes H1 are provided, the fourth reinforcement rib R4 can be formed in a cross shape so as to partition a space formed by the first pillar 1817 into four.

The first reinforcement ribs R1 and the third reinforcement ribs R3 can be formed in the same number and can be formed at positions facing each other.

The second reinforcement rib R2 can include a bridge portion R22 connected to the first reinforcement rib R1 and the third reinforcement rib R3.

In this case, the first reinforcement rib R1, the second reinforcement rib R2, and the third reinforcement rib R3 can be integrally formed.

According to the above-described configuration, a strength of the first discharge plenum 1810 can efficiently increase by the first to third reinforcement ribs R1 to R3.

In addition, a plurality of fifth reinforcement ribs R5 protruding to the first discharge space 1040*a* can be formed on an inner wall surface of the first bottom portion 1813.

According to the above-described configuration, a strength of the first bottom portion 1813 increases by the plurality of fifth reinforcement ribs R5.

A first bearing communication hole 125*b* and a second bearing communication hole H2 communicating with a third discharge space 1040*c* are formed in a part of the first bottom portion 1813.

In other words, the second bearing communication hole H2 is formed in a part of the first bottom portion 1813 positioned in the third discharge space 1040*c*.

Accordingly, some of the refrigerant in the third discharge space 1040*c* can flow into the first bearing communication hole 125*b* through the second bearing communication hole H2.

According to the above-described configuration, since the present disclosure can shorten a path for supplying the refrigerant to the gas bearings compared to the linear compressor according to related art in which the second bearing communication hole is separately formed in the discharge cover 185, the present disclosure can effectively perform a lubricating action of the gas bearings, and also improve the processing and manufacturing of the discharge cover 1850.

A diameter and/or a size of the second bearing communication hole H2 can be smaller than a diameter of the first bearing communication hole 125*b*. Through this, the present disclosure can appropriately adjust an amount of refrigerant supplied to the gas bearing among the refrigerant flowing inside the discharge cover assembly 1800.

Alternatively, a diameter and/or a size of the second bearing communication hole H2 can correspond to a diameter of the first bearing communication hole 125*b*.

In this case, the present disclosure can prevent compression and expansion that can occur in a process of supplying the refrigerant flowing inside the discharge cover assembly 1800 to the gas bearing, thereby preventing a pressure drop in the gas bearing and improving the efficiency of the gas bearing.

The first wall 1815 is disposed at a predetermined distance D1 from the first cylindrical body 1811. Accordingly, a pulsation reduction space A1 for reducing discharge pulsation is formed between an inner wall surface of the first wall 1815 and an outer wall surface of the first cylindrical body 1811.

A first inlet hole H3 is formed in a part of the outer wall surface of the first cylindrical body 1811 and introduces the refrigerant introduced into the second discharge space 1040*b* through the plurality of first discharge holes H1 into the pulsation reduction space A1. The first inlet hole H3 can be formed by bending a part of the wall surface of the first cylindrical body 1811 toward the first pillar 1817 and can elongate axially.

A second discharge hole H4 is formed in a part of the first wall 1815 and introduces the refrigerant in the pulsation reduction space A1 into the third discharge space 1040*c*. The second discharge hole H4 can be formed by bending a part of the wall surface of the first wall 1815 toward the second discharge plenum 1830 and can elongate axially.

Accordingly, some of the refrigerant introduced into the second discharge space 1040*b* is introduced into the pulsation reduction space A1 through the first inlet hole H3, and then flows to the outside of the first wall 1815 through the second discharge hole H4 and is introduced into the third discharge space 1040*c*. Thereafter, the part of the refrigerant sequentially passes through the second bearing communication hole H2 and the first bearing communication hole 125*b* and lubricates the piston and the cylinder.

A plurality of sixth reinforcement ribs R6 are formed on an outer wall surface of the first wall 1815. The sixth reinforcement rib R6 protrudes to the second discharge plenum 1830 and elongates axially. The plurality of sixth reinforcement ribs R6 are positioned in the third discharge space 1040*c* formed between an outer surface of the first wall 1815 of the first discharge plenum 1810 and an inner surface of the second cylindrical body 1831 of the second discharge plenum 1830, and can reduce the discharge pulsation of the refrigerant.

According to the above-described configuration, the strength of the first wall 1815 increases by the sixth reinforcement ribs R6, and the discharge pulsation is reduced.

The second discharge plenum 1830 can be formed in a shape with an open rear.

The second discharge plenum 1830 is coupled to the first discharge plenum 1810 and is positioned in the inner space of the discharge cover 1850.

The second discharge plenum 1830 can be formed of a material having a heat transfer coefficient different from a heat transfer coefficient of a material forming the discharge cover 1850 and/or a material forming the first discharge plenum 1810, but can be formed of polyamide 66 (PA66) in the same manner as the first discharge plenum 1810.

The second discharge plenum 1830 includes a second cylindrical body 1831 and a second bottom portion 1833 supporting the second cylindrical body 1831.

The second discharge space 1040*b* is formed between an upper inner surface of the second cylindrical body 1831 and an upper outer surface of the first cylindrical body 1811. The second discharge space 1040*b* communicates with the first discharge space 1040*a* through the first discharge hole H1.

The second bottom portion 1833 includes a third stepped portion 1833*a*. The second cylindrical body 1831 protrudes from the third stepped portion 1833*a* to the discharge cover 1850.

The second cylindrical body 1831 includes a fourth stepped portion 1831*a*, a fifth stepped portion 1831*b*, and a sixth stepped portion 1831*c*. A convex portion 1837 inserted into a protrusion 1855 of the discharge cover 1850 is formed at the sixth stepped portion 1831*c*.

A plurality of seventh reinforcement ribs R7 can be formed on an inner wall surface of the second cylindrical body 1831. The seventh reinforcement rib R7 protrudes from the inner wall surface of the second cylindrical body 1831 to the second discharge space 1040*b* and elongates axially.

According to the above-described configuration, a strength of a wall surface of the second cylindrical body 1831 increases by the plurality of seventh reinforcement ribs R7.

In a state in which the first discharge plenum 1810 and the second discharge plenum 1830 are coupled, the sixth reinforcement rib R6 formed on the first wall 1815 of the first discharge plenum 1810 is disposed not to match the seventh reinforcement rib R7 formed on the inner wall surface of the second cylindrical body 1831 of the second discharge plenum 1830.

For example, the seventh reinforcement rib R7 can be disposed at an intermediate point between the two adjacent sixth reinforcement ribs R6.

In a state in which the first discharge plenum 1810 and the second discharge plenum 1830 are coupled, the third discharge space 1040*c* is formed between the first wall 1815 of the first discharge plenum 1810 and the inner wall surface of the second cylindrical body 1831 of the second discharge plenum 1830.

The third discharge space 1040*c* is a space formed to supply some of the refrigerant flowing in the discharge cover assembly 1800 to the piston and the cylinder.

However, since the sixth reinforcement rib R6 formed on the first wall 1815 of the first discharge plenum 1810 is disposed not to match the seventh reinforcement rib R7 formed on the inner wall surface of the second cylindrical body 1831 of the second discharge plenum 1830 in a state in which the first discharge plenum 1810 and the second discharge plenum 1830 are coupled, the pulsation reduction effect of the refrigerant flowing into a third discharge hole H5 through the third discharge space 1040*c* is improved.

On an inner surface of the fourth stepped portion 1831*a* of the second cylindrical body 1831, a plurality of eighth reinforcement ribs R8, that protrude toward the discharge valve assembly 170 and elongate radially, and at least one ninth reinforcement rib R9, that protrudes to the discharge valve assembly 170 and is formed in a circumferential direction, are formed.

The eighth reinforcement rib R8 and the ninth reinforcement rib R9 can be connected to each other and formed integrally.

Further, the eighth reinforcement rib R8 extends to the inside of the ninth reinforcement rib R9.

That is, the eighth reinforcement rib R8 includes an extension extending to the inside of the ninth reinforcement rib R9.

The extension of the ninth reinforcement rib R9 is positioned in an area facing an area in which the first discharge hole H1 is formed.

According to the above-described configuration, since the extension of the eighth reinforcement rib R8 acts as a resistance with respect to the refrigerant introduced into the second discharge space 1040*b* through the first discharge hole H1, the pulsation reduction effect is improved.

In particular, the extension of the eighth reinforcement rib R8 can improve the pulsation reduction effect of the refrigerant discharged to the outside through the third discharge hole H5.

A second wall 1835 is formed on the inner surface of the fourth stepped portion 1831*a* of the second cylindrical body 1831 and is inserted into the pulsation reduction space A1 formed between the first cylindrical body 1811 and the first wall 1815 of the first discharge plenum 1810.

The second wall 1835 can be connected to the plurality of eighth reinforcement ribs R8 and integrally formed with the eighth reinforcement ribs R8, so as to act as a reinforcement rib for reinforcing the strength of the second cylindrical body 1831.

Since some of the refrigerant can be introduced into the pulsation reduction space A1 through the first inlet hole H3, a thickness T1 of the second wall 1835 can be the same as a width A1 of the pulsation reduction space A1, i.e., a distance D1 between the inner wall surface of the first wall 1815 and the outer wall surface of the first cylindrical body 1811. Thus, the second wall 1835 of the second discharge plenum 1830 can contact each of the inner wall surface of the first wall 1815 and the outer wall surface of the first cylindrical body 1811.

However, the pulsation reduction space A1 needs to include a space for allowing some of the refrigerant in the second discharge space 1040*b* to flow into the third discharge space 1040*c*. Therefore, a depth D2 at which the second wall 1835 is inserted into the pulsation reduction space A1 can be less than a depth D3 of the pulsation reduction space A1.

The third discharge hole H5 is formed in the fifth stepped portion 1831*b* of the second cylindrical body 1831 and discharges the refrigerant flowing into the third discharge space 1040*c* to the outside. A loop pipe 115*a* is connected to the third discharge hole H5.

An O-ring insertion groove 1833*b*, into which an O-ring 1860 is inserted, is formed on the outer surface of the second bottom portion 1833. The O-ring 1860 reduces a hitting sound of the discharge valve 171 and also prevents leakage of the refrigerant.

Accordingly, after the O-ring 1860 is inserted into the O-ring insertion groove 1833*b* of the second discharge plenum 1830 to which the first discharge plenum 1810 is press-fitted, the discharge cover assembly 1800 can be manufactured by press-fitting the second discharge plenum 1830 to the discharge cover 1850.

The O-ring 1860 prevents the refrigerant flowing inside the discharge cover assembly 1800 from leaking to the outside through the space between the discharge cover 1850 and the second discharge plenum 1830, and also efficiently reduces the hitting sound of the discharge valve 171 which is a main noise source of the linear compressor.

The discharge cover 1850 can be formed in a shape with an open rear. The discharge cover 1850 can be coupled to the frame 120. A rear surface of the discharge cover 1850 can be coupled to a front surface of the first flange portion 122 of the frame 120.

The discharge cover 1850 can include a third cylindrical body 1851 and a third bottom portion 1853 supporting the third cylindrical body 1851.

The third bottom portion 1853 can include a seventh stepped portion 1853*a*, and the third cylindrical body 1851 can protrude axially forward from the seventh stepped portion 1853*a*.

In a state in which the second discharge plenum 1830 is press-fitted, the outer surface of the second bottom portion 1833 of the second discharge plenum 1830 can adhere to the seventh stepped portion 1853*a* of the third bottom portion 1853.

A depth D4 of the seventh stepped portion 1853*a* can be the same as a thickness T2 of the second bottom portion 1833, so that the seventh stepped portion 1853*a* of the third bottom portion 1853 contacts the second bottom portion 1833 of the second discharge plenum 1830.

Accordingly, the present disclosure can prevent the refrigerant flowing inside the discharge cover assembly 1800 from leaking to the outside through the space between the discharge cover 1850 and the second discharge plenum 1830.

In a state in which the second discharge plenum 1830 is press-fitted, the outer wall surface of the second discharge plenum 1830 and the inner wall surface of the discharge cover 1850 can be spaced apart from each other so as to form a thermal insulation space A2.

In particular, the outer wall surface of the second cylindrical body 1831 of the second discharge plenum 1830 and the inner wall surface of the third cylindrical body 1851 of the discharge cover 1850 can be spaced apart from each other so as to form the thermal insulation space A2.

According to the above-described configuration, the present disclosure can more effectively suppress heat of the discharge refrigerant from being transferred to the frame 120 through the discharge cover assembly 1800.

The rear surface of the third bottom portion 1853 of the discharge cover 1850 can be coupled to the front surface of the first flange portion 122 of the frame 120.

In this case, a mechanical coupling member such as a bolt can be coupled to a coupling hole 1853*b* formed in the third bottom portion 1853 and a fixing groove of the first flange portion 122 to couple the discharge cover 1850 to the front of the frame 120.

The third cylindrical body 1851 can include an eighth stepped portion 1851*a*, a ninth stepped portion 1851*b*, and a tenth stepped portion 1851*c*.

The discharge cover 1850 can include a protrusion 1855 that protrudes axially forward from the ninth stepped portion 1851*b* and the tenth stepped portion 1851*c* of the third cylindrical body 1851. The protrusion 1855 can be formed in a central area of the third cylindrical body 1851.

The convex portion 1837 of the second discharge plenum 1830 can be disposed at the protrusion 1855. Through this, the space efficiency within the discharge cover 1850 can be improved.

A pipe insertion hole H6, into which the loop pipe 115*a* is inserted, can be formed in the ninth stepped portion 1851*b* and the tenth stepped portion 1851*c* of the third cylindrical body 1851.

Thus, one end of the loop pipe 115*a* inserted into the pipe insertion hole H6 can be connected to the third discharge hole H5 formed in the fifth stepped portion 1831*b* of the second cylindrical body 1831 of the second discharge plenum 1830.

The discharge cover 1850 can be formed of an aluminum alloy.

It can be seen from FIG. 11 that a noise measured at a high frequency band (e.g., 2.5 kHz) at the rear of a refrigerator including the linear compressor according to an implementation of the present disclosure is improved compared to a noise measured at the high frequency band at the rear of a refrigerator including the linear compressor according to related art.

It can be seen from FIG. 12 that a pulsating component of a refrigerator including the linear compressor according to an implementation of the present disclosure at a high frequency band (e.g., 2.5 kHz) is improved compared to a pulsating component of a refrigerator including the linear compressor according to related art at the high frequency band.

Some implementations or other implementations of the present disclosure described above are not exclusive or distinct from each other. Some implementations or other implementations of the present disclosure described above can be used together or combined in configuration or function.

For example, configuration "A" described in an implementation and/or the drawings and configuration "B" described in another implementation and/or the drawings can be combined with each other. That is, even if the combination between the configurations is not directly described, the combination is possible except in cases where it is described that it is impossible to combine.

The above detailed description is merely an example and is not to be considered as limiting the present disclosure. The scope of the present disclosure should be determined by rational interpretation of the appended claims, and all variations within the equivalent scope of the present disclosure are included in the scope of the present disclosure.

What is claimed is:

1. A linear compressor comprising:

a frame;

a cylinder disposed in the frame;

a piston disposed in the cylinder and configured to axially reciprocate in the cylinder;

a discharge valve disposed at a first side of the piston; and a discharge cover assembly coupled to the frame and disposed at the first side of the piston, wherein the discharge cover assembly comprises:

a discharge cover that defines an inner space, a first discharge plenum that is disposed in the inner space of the discharge cover, the first discharge plenum defining a first discharge space therein, and a second discharge plenum disposed between the first discharge plenum and the discharge cover, the second discharge plenum defining (i) a second discharge space in fluid communication with the first discharge space and (ii) a third discharge space in fluid communication with the second discharge space, wherein the second discharge space and the third discharge space are defined between the first discharge plenum and the second discharge plenum, wherein the first discharge plenum comprises:

a first cylindrical body that defines the first discharge space, the first discharge space being configured to receive refrigerant discharged through the discharge valve, a first bottom portion that supports the first cylindrical body, a first pillar that protrudes from a central part of the first cylindrical body toward the discharge valve, and a first wall that has a ring shape protruding from the first bottom portion and surrounding the first cylindrical body, wherein the frame defines a first bearing communication hole, wherein the first bottom portion defines a second bearing communication portion in fluid communication with the third discharge space, and wherein the second bearing communication portion is configured to provide a portion of the refrigerant in the third discharge space to the first bearing communication hole to thereby lubricate the cylinder and the piston.

2. The linear compressor of claim 1, wherein a heat transfer coefficient of a material of the first discharge plenum and the second discharge plenum is different from a heat transfer coefficient of a material of the discharge cover.

3. The linear compressor of claim 1, wherein at least one of the first discharge plenum or the second discharge plenum is made of a polyamide resin.

4. The linear compressor of claim 1, wherein the first pillar defines a plurality of first discharge holes at a bottom surface of the first pillar, and wherein the plurality of first discharge holes pass through the bottom surface of the first pillar and are configured to discharge the refrigerant from the second discharge space of the second discharge plenum.

5. The linear compressor of claim 1, wherein the first wall and the first cylindrical body are spaced apart from each other and define a pulsation reduction space between an inner surface of the first wall and an outer surface of the first cylindrical body, the pulsation reduction space being configured to reduce a discharge pulsation of the refrigerant.

6. The linear compressor of claim 5, wherein the outer surface of the first cylindrical body defines a first inlet hole configured to introduce the refrigerant from the second discharge space into the pulsation reduction space, and wherein the first wall defines a second discharge hole configured to introduce the refrigerant from the pulsation reduction space into the third discharge space.

7. The linear compressor of claim 5, wherein the second discharge plenum comprises a second wall, at least a portion of the second wall being inserted into the pulsation reduction space of the first discharge plenum.

8. The linear compressor of claim 7, wherein a thickness of the second wall is equal to a width of the pulsation reduction space, and wherein a length of the portion of the second wall inserted into the pulsation reduction space is less than a depth of the pulsation reduction space.

9. The linear compressor of claim 4, wherein the first discharge plenum comprises at least two of:

a plurality of first reinforcement ribs that protrude from an inner wall surface of the first cylindrical body toward the first discharge space and extend axially;

a second reinforcement rib that has a ring shape and protrudes from an inner upper surface of the first cylindrical body toward the first discharge space;

a plurality of third reinforcement ribs that protrude from an inner wall surface of the first pillar toward the first discharge space and extends axially;

a fourth reinforcement rib that is disposed at an outer wall surface of the first pillar and partitions the plurality of first discharge holes;

a plurality of fifth reinforcement ribs that protrudes from an inner wall surface of the first bottom portion toward the first discharge space; and a plurality of sixth reinforcement ribs that protrude from an outer wall surface of the first wall toward the second discharge plenum and extend axially.

10. The linear compressor of claim 9, wherein the first discharge plenum comprises the plurality of first reinforcement ribs, the second reinforcement rib, and the plurality of third reinforcement ribs that are integrally formed with the first discharge plenum, wherein a number of the plurality of first reinforcement ribs is equal to a number of the plurality of third reinforcement ribs, each of the plurality of first reinforcement ribs facing one of the plurality of third reinforcement ribs, and wherein the second reinforcement rib comprises a bridge portion that connects one of the plurality of first reinforcement ribs to one of the plurality of third reinforcement ribs.

11. The linear compressor of claim 9, wherein the second discharge plenum comprises a second cylindrical body and a second bottom portion that supports the second cylindrical body, wherein the first discharge plenum comprises the plurality of sixth reinforcement ribs, wherein the second discharge plenum further comprises a plurality of seventh reinforcement ribs that protrude from an inner wall surface of the second cylindrical body toward the third discharge space and extends axially, and wherein the plurality of sixth reinforcement ribs and the plurality of seventh reinforcement ribs are disposed in the third discharge space, the third discharge space being defined between an outer surface of the first wall and an inner surface of the second cylindrical body and configured to reduce a discharge pulsation of the refrigerant.

12. The linear compressor of claim 11, wherein the plurality of sixth reinforcement ribs of the first discharge plenum are disposed at positions offset from the plurality of seventh reinforcement ribs of the second discharge plenum.

13. The linear compressor of claim 11, wherein the second discharge plenum further comprises:

a plurality of eighth reinforcement ribs that protrude from the inner surface of the second cylindrical body toward the discharge valve and extends radially; and at least one ninth reinforcement rib that protrudes from the inner surface of the second cylindrical body toward the discharge valve and extends in a circumferential direction of the second cylindrical body, wherein the plurality of eighth reinforcement ribs are connected to the at least one ninth reinforcement rib, and wherein the plurality of eighth reinforcement ribs and the at least one ninth reinforcement rib are formed integrally with the second discharge plenum.

14. The linear compressor of claim 11, wherein the second cylindrical body further defines a third discharge hole configured to discharge the refrigerant toward an outside of the discharge cover assembly, and wherein the linear compressor further comprises a loop pipe that is connected to the third discharge hole.

15. The linear compressor of claim 11, wherein the second discharge plenum defines an O-ring insertion groove at an outer surface of the second bottom portion, and wherein the linear compressor further comprises an O-ring inserted into the O-ring insertion groove and positioned between the second bottom portion and the discharge cover.

16. The linear compressor of claim 11, wherein the discharge cover comprises a third cylindrical body and a third bottom portion that supports the third cylindrical body, and wherein the frame comprises a flange portion that is coupled to the third bottom portion by a mechanical coupling member.

17. The linear compressor of claim 16, wherein an inner wall surface of the third cylindrical body and an outer wall surface of the second cylindrical body are spaced apart from each other and define a thermal insulation space between the inner wall surface of the third cylindrical body and the outer wall surface of the second cylindrical body.

18. The linear compressor of claim 1, wherein the first discharge plenum or the second discharge plenum are made of a polyamide resin.

* * * * *